US010021964B2

(12) United States Patent
Brewer

(10) Patent No.: US 10,021,964 B2
(45) **Date of Patent: *Jul. 17, 2018**

(54) REPLACEMENT INDICATING BRUSH

(71) Applicant: L'Oreal, Paris (FR)

(72) Inventor: Gerald Keith Brewer, Redmond, WA (US)

(73) Assignee: L'Oreal, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/318,589

(22) PCT Filed: Jun. 15, 2015

(86) PCT No.: PCT/US2015/035865

§ 371 (c)(1),
(2) Date: Dec. 13, 2016

(87) PCT Pub. No.: WO2015/192139

PCT Pub. Date: Dec. 17, 2015

(65) Prior Publication Data

US 2017/0119144 A1 May 4, 2017

Related U.S. Application Data

(63) Continuation-in-part of application No. 14/304,478, filed on Jun. 13, 2014, now abandoned.

(51) Int. Cl.
*A46B 13/00* (2006.01)
*A46B 13/02* (2006.01)
(Continued)

(52) U.S. Cl.
CPC ..... *A46B 15/001* (2013.01); *A46B 13/008* (2013.01); *A46B 13/02* (2013.01); *A47K 7/04* (2013.01); *A46B 2200/102* (2013.01)

(58) Field of Classification Search
CPC .... A46B 7/00; A46B 7/06; A46B 7/08; A46B 9/00; A46B 9/02; A46B 9/04; A46B 9/06;
(Continued)

(56) References Cited

U.S. PATENT DOCUMENTS 3,196,299 A * 7/1965 Kott ..... A61C 17/3481 15/22.1
3,542,519 A 11/1970 Montalto et al.
(Continued)

FOREIGN PATENT DOCUMENTS

CN 1097969 A 2/1995
CN 1665427 A 9/2005
(Continued)

OTHER PUBLICATIONS

International Search Report dated Sep. 10, 2015, issued in corresponding International Application No. PCT/US2015/035865, filed Jun. 15, 2015, 5 pages.
(Continued)

*Primary Examiner* — Mark Spisich
(74) *Attorney, Agent, or Firm* — Christensen O'Connor Johnson Kindness PLLC

(57) ABSTRACT

A wear indicator is provided, which is suitable for use with a workpiece, such as a replaceable brush head. In use, the wear indicator can provide an indication to the user recommending that the workpiece be replaced.

18 Claims, 19 Drawing Sheets

(51) Int. Cl.
*A46B 15/00* (2006.01)
*A47K 7/04* (2006.01)

(58) Field of Classification Search
CPC ..... A46B 13/00; A46B 13/008; A46B 13/02; A46B 13/023; A46B 15/0008; A46B 15/001; A46B 15/0038; A46B 2200/10; A46B 2200/1006; A46B 2200/102
See application file for complete search history.

(56) References Cited

U.S. PATENT DOCUMENTS

| | | | |
|---|---|---|---|
| 4,802,255 | A | 2/1989 | Breuer et al. |
| 5,062,209 | A | 11/1991 | Rais |
| 5,313,909 | A | 5/1994 | Tseng et al. |
| 5,322,031 | A | 6/1994 | Lerner et al. |
| 5,388,331 | A | 2/1995 | Doroodian-Shoja Siamak |
| 5,652,990 | A | 8/1997 | Driesen et al. |
| 5,860,183 | A | 1/1999 | Kam |
| 5,906,834 | A | 5/1999 | Tseng |
| 5,998,431 | A | 12/1999 | Tseng et al. |
| 6,020,425 | A | 2/2000 | Wang et al. |
| 6,058,541 | A | 5/2000 | Masterman et al. |
| 6,295,733 | B1 | 10/2001 | Wexler et al. |
| 6,412,139 | B1 | 7/2002 | Weihrauch |
| 6,482,511 | B1 | 11/2002 | Martinez Antonio |
| 7,338,664 | B2 | 3/2008 | Tseng et al. |
| 7,547,737 | B2 | 6/2009 | Kochvar et al. |
| 8,448,286 | B2 | 5/2013 | Driesen et al. |
| 9,307,827 | B2 * | 4/2016 | Brewer ..... A46B 15/001 |
| 2002/0088068 | A1 | 7/2002 | Levy et al. |
| 2002/0138926 | A1 | 10/2002 | Brown, Jr. et al. |
| 2003/0077107 | A1 | 4/2003 | Kuo |
| 2004/0134010 | A1 | 7/2004 | Tseng et al. |
| 2005/0204500 | A1 | 9/2005 | Mikula |
| 2006/0282963 | A1 | 12/2006 | Brown, Jr. et al. |
| 2007/0207440 | A1 | 9/2007 | Chen et al. |
| 2008/0295760 | A1 | 12/2008 | Wielstra |
| 2008/0313835 | A1 | 12/2008 | Russell et al. |
| 2010/0293734 | A1 | 11/2010 | Driesen et al. |
| 2013/0007969 | A1 | 1/2013 | Driesen et al. |
| 2014/0082866 | A1 | 3/2014 | Fischer et al. |
| 2014/0202493 | A1 | 7/2014 | Zelickson et al. |
| 2015/0189980 | A1 | 7/2015 | Hwang et al. |

FOREIGN PATENT DOCUMENTS

| | | | |
|---|---|---|---|
| CN | 101203157 | A | 6/2008 |
| CN | 101277629 | A | 10/2008 |
| CN | 201640925 | U | 11/2010 |
| GB | 2323026 | A | 9/1998 |
| JP | 2009240768 | A | 10/2009 |
| WO | 2004/002267 | * | 1/2004 |
| WO | 2006/137028 | A1 | 12/2006 |
| WO | 2013/191389 | A1 | 12/2013 |

OTHER PUBLICATIONS

International Preliminary Report on Patentability and Written Opinion dated Dec. 15, 2016, issued in corresponding International Application No. PCT/US2015/035865, filed Jun. 15, 2015, 10 pages.

Communication Pursuant to Article 94(3) EPC dated Dec. 18, 2017, issued in corresponding European Application No. 15 731 228.1, filed Jun. 15, 2015, 4 pages.

Office Action dated Oct. 9, 2017, issued in corresponding Chinese Application No. 201580028377.0, filed Jun. 15, 2015, 33 pages.

* cited by examiner

REPLACEMENT INDICATING BRUSH

CROSS-REFERENCE TO RELATED APPLICATIONS

This application is the National Stage of International Application No. PCT/US2015/035865, filed Jun. 15, 2015, which is a continuation in part of U.S. patent application Ser. No. 14/304,478, filed Jun. 13, 2014, now abandoned.

BACKGROUND

Motorized skin care devices are currently used to cleanse, exfoliate, and massage a subject's skin. Typically, these skin care devices include a replaceable workpiece selectively coupled to a personal care appliance. The workpiece, sometimes referred to as a head, includes an applicator that applies a skin care treatment to the subject's skin. The personal care appliance imparts motion to the workpiece in order to increase the effectiveness of the treatment. Commercially available skin care devices typically employ either rotational or oscillatory motion.

In several popular skin care devices on the market today, the applicator includes one or more bristled tufts, and is sometimes referred to as a brush head. During use, the bristles of the brush head can become damaged based on repetitive contact with the subject's skin. The bristles can also lose their effectiveness due to the presence of dirt, oil, make-up, etc. Further, since these devices are used in wet conditions and are subject to contact with human beings, undesirable bacteria, fungus, flora and/or fauna may eventually be present on the brush head over time.

Most users do not know when to replace the brush head of their skin care device, and thus, usually use the brush head way beyond its intended lifespan. Accordingly, many manufacturers have a recommended replacement period for the brush head to address this problem. While successful with some clientele, other remedies are desired to assist users to replace the brush head at the appropriate time.

SUMMARY

To address the problems raised above, among others, several examples of a replacement indictor are disclosed, which are suitable for use with a workpiece, such as a replaceable brush head. In some embodiments, the replacement indicator is configured is in the form of a wear indicator. In use, the replacement indicator can provide an indication to the user recommending that the workpiece be replaced. Such an indication can occur based on number of uses, time, and/or environmental conditions, etc.

In accordance with an aspect of the present disclosure, a skin brush head for use with a motorized personal appliance is provided. The skin brush head includes a body having an outer surface, and a treatment applicator coupled to the outer surface of the body. The treatment applicator in one embodiment is configured to apply treatment to a subject's skin. The skin brush head also includes a replacement indicator including an indicator member configured to move to a replacement position with respect to the treatment applicator after an amount of usage of the skin brush head has occurred. The replacement position in one embodiment indicates to a user a recommendation for replacement of the skin brush head.

In accordance with an aspect of the present disclosure, a removable workpiece for use with a motorized personal appliance is provided. The removable workpiece includes a body having an outer surface and a treatment applicator coupled to the outer surface of the body. The treatment applicator, such as a plurality of bristles in one embodiment, is configured to apply treatment to a subject's skin. The workpiece also includes means for providing a workpiece replacement recommendation after an amount of usage of the workpiece has occurred. The means for providing a workpiece replacement recommendation includes in one embodiment an indicator movable to a deployed position in which the member is adjacent an outer end of the treatment applicator.

In accordance with an aspect of the present disclosure, a removable workpiece for use with a motorized personal appliance is provided. The removable workpiece includes a body having an outer surface and a treatment applicator coupled to the outer surface of the body. The treatment applicator, such as a plurality of bristles in one embodiment, is configured to apply treatment to a subject's skin. The workpiece also includes means for providing a workpiece replacement recommendation after an amount of usage of the workpiece has occurred. The means for providing a workpiece replacement recommendation includes an indicator movable from a loaded position, in which the indictor is outwardly biased by a spring against a retainer, and a replacement recommendation position in which the indictor is adjacent an outer end of the treatment applicator. The workpiece further includes trigger means for triggering the movement of the indicator member from the loaded position to the replacement signaling position under the force of the spring.

In accordance with an aspect of the present disclosure, a removable workpiece for use with a motorized personal appliance is provided. The removable workpiece includes a body having an outer surface and a treatment applicator coupled to the outer surface of the body. The treatment applicator, such as a plurality of bristles in one embodiment, is configured to apply treatment to a subject's skin. The workpiece also includes a replacement indictor carried by the body and configured to move between the spring biased position and a spring unbiased position, a retainer configured to retain the replacement indicator at the spring biased position, and trigger means for triggering the movement of the replacement indicator member from the spring biased position to the spring unloaded position.

In accordance with an aspect of the present disclosure, a removable workpiece for use with a motorized personal appliance is provided. The removable workpiece includes a body having an outer surface and a treatment applicator coupled to the outer surface of the body. The treatment applicator, such as a plurality of bristles in one embodiment, is configured to apply treatment to a subject's skin. The workpiece also includes a replacement indictor carried by the body and configured to move between the spring biased position and a spring unbiased position and a biodegradable retainer configured to retain the replacement indicator at the spring biased position. The biodegradable retainer in one embodiment is configured to trigger the movement of the replacement indicator member from the spring biased position to the spring unloaded position based on time and environmental conditions.

In accordance with an aspect of the present disclosure, a removable workpiece for use with a motorized personal appliance is provided. The removable workpiece includes a body having an outer surface and a treatment applicator coupled to the outer surface of the body. The treatment applicator, such as a plurality of bristles in one embodiment, is configured to apply treatment to a subject's skin. The workpiece also includes a biodegradable replacement indictor carried by the body and configured to move between the spring biased position and a spring unbiased position and a retainer configured to retain the replacement indicator at the spring biased position. The biodegradable replacement indictor in one embodiment is configured to trigger the movement of the replacement indicator member from the spring biased position to the spring unloaded position based on time and environmental conditions.

In accordance with an aspect of the present disclosure, a removable workpiece for use with a motorized personal appliance is provided. The removable workpiece includes a body having an outer surface and a treatment applicator coupled to the outer surface of the body. The treatment applicator, such as a plurality of bristles in one embodiment, is configured to apply treatment to a subject's skin. The workpiece also includes a biodegradable replacement indictor carried by the body and configured to move between the spring biased position and a spring unbiased position and a biodegradable retainer configured to retain the biodegradable replacement indicator at the spring biased position. The biodegradable replacement indictor and/or the biodegradable retainer in one embodiment are configured to trigger the movement of the replacement indicator member from the spring biased position to the spring unloaded position based on time and environmental conditions.

In accordance with an aspect of the present disclosure, a powered skin care device is provided. The device includes a powered handle having a motor and a replaceable skin brush head removably mounted to the powered handle and configured to be moved by the motor. In accordance with various embodiments, the skin brush head can be configured according to any of the Claims herein.

In accordance with an aspect of the present disclosure, a powered treatment device is provided. The device includes a powered handle having a motor and a skin brush head removably mounted to the powered handle and configured to be moved by the motor. In one embodiment, the skin brush head includes a body having an outer surface, a plurality of bristles that extend outwardly from the outer surface of the body, and a replacement indicator associated with the skin brush head. The replacement indicator in one embodiment includes an indication member configured to move to a replacement signaling position with respect to the plurality of bristles for indicating to a user a recommendation for replacement of the skin brush head after an amount of usage of the skin brush head.

In accordance with an aspect of the present disclosure, a skin brush head for use with a motorized personal appliance is provided. The skin brush head includes a body having an outer surface, a plurality of bristled tufts coupled to the outer surface of the bod, and a wear indicator associated with the brush head. The wear indicator in one embodiment is configured to provide an indication to a user recommending replacement of the skin brush head after an amount of usage of the skin brush head.

In accordance with an aspect of the present disclosure, a skin brush head for use with a motorized personal appliance is provided. The brush head includes a body having an outer surface, a treatment applicator, such as a plurality of bristled tufts, coupled to the outer surface of the body. The treatment applicator in one embodiment is configured to apply treatment to a subject's skin. The brush head also includes means for providing an indication to a user recommending replacement of the skin brush head after an amount of usage of the skin brush head.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this disclosed subject matter will become more readily appreciated as the same become better understood by reference to the following detailed description, when taken in conjunction with the accompanying drawings, wherein.

DETAILED DESCRIPTION

Figure 1:
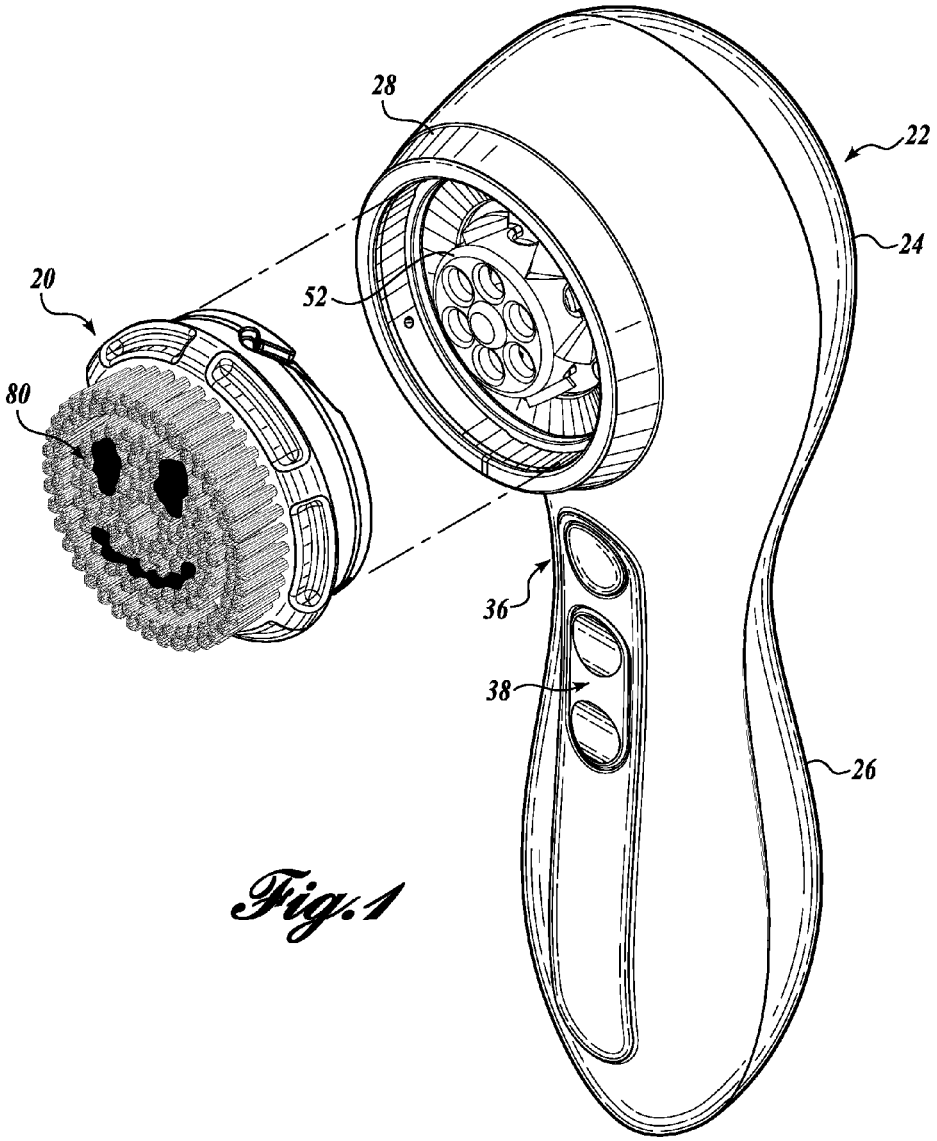
FIG. 1 is an isometric view of one example of a brush head in accordance with aspects of the present disclosure, the brush head exploded from a suitable personal care appliance.

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following discussion provides examples of devices that relate to skin care, and more particularly, to replaceable brush heads suitable for used with a personal care appliance for skin treatment of any exterior body part of a subject. Examples of the replaceable brush heads include a replacement indicator, which can provide an indication to the user recommending that the workpiece be replaced. In some examples herein, workpiece replacement is recommended after about three (3) months of daily use, although other scheduled replacement protocols may be used.

In some examples, the replacement indicator is a colored material layer that is printed, dipped, painted or otherwise applied to a plurality of bristle tips of at least one section of the brush. The material layer, once applied, can be in the form of picture, such as a flower, a pattern, such as a ring, or indicia, such as symbols, letters, numbers or words. In some embodiments, this material layer or coating wears or fades via abrasion, loss of adhesion, solubility, etc., and combinations thereof, thereby indicating a need for replacement. In other embodiments, this material layer or coating wears or fades via abrasion, loss of adhesion, solubility, etc., and combinations thereof, which can reveal the color of the substrate, such as the bristles, brush body, etc., thereby indicating a need for replacement. In yet other embodiments, the material layer or coating is removed over time via abrasion, diminishing adhesion, solubility, etc., and combinations thereof, to reveal a second underlying material layer or coating, which presents a word, a symbol or another indicator that is indicative of a recommendation for replacement.

In other examples, the replacement indicator can include a mechanical actuator or "pop-up" device, which indicates or provides a signal to the user that the workpiece is in need of replacement. In embodiments described in more detail below, such devices include a piston-like indicator loaded in a stowed position against a biasing force of a spring. The devices remain loaded in the stowed position via a retainer or the like. By activation of a trigger mechanism, the loaded piston-like indicator is released from the stowed position, thereby transitioning to the deployed or replacement signaling position. In some examples, the retainer is a wear layer that weakens or degrades over time. In other embodiments, the retainer includes a time and/or environmentally sensitive adhesive. In some embodiments, the trigger mechanism is triggered by degradation, biodegradation, etc., of the retainer and/or piston-like indicator responsive to environmental conditions over time. In some of these embodiments, the retainer or the piston-like indicator, or both, include one or more oxo-biodegradable plastics, biobased polymers, etc., or blends thereof.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. Further, it will be appreciated that embodiments of the present disclosure may employ any combination of features described herein.

Figure 3:
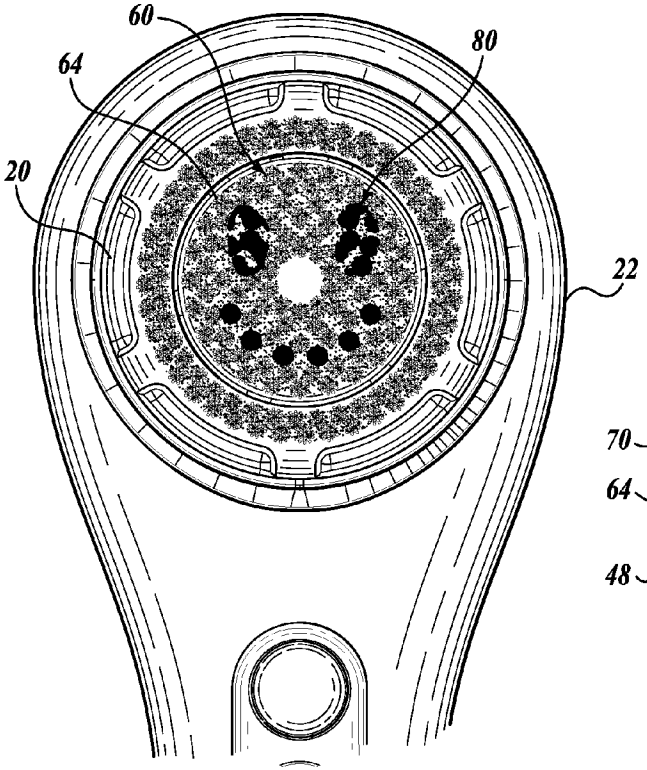
FIG. 3 is a top view of a brush head coupled to a personal care appliance, the brush head having one example of a wear indicator in accordance with aspects of the present disclosure.

Turning now to FIG. 1, there is shown one example of a workpiece, generally designated 20, formed in accordance with aspects of the present disclosure. The workpiece 20 is suitable for use with a personal care appliance, such as appliance 22. In the embodiment shown, the workpiece 20 is in the form of a skin brush head (hereinafter "brush head 20"). As will be described in more detail below, the brush head 20 also includes a replacement indicator 80, sometimes referred to as a wear indicator, which provides a visual cue to the user that recommends replacement of the brush head 20, as shown for example in FIG. 3. In use, the brush head 20 can be rotated, reciprocated, oscillated, etc., by the personal care appliance 22 over a subject's skin in order to apply a treatment, e.g., cleanse, massage, exfoliate, etc., to the subject's skin.

Figure 2:
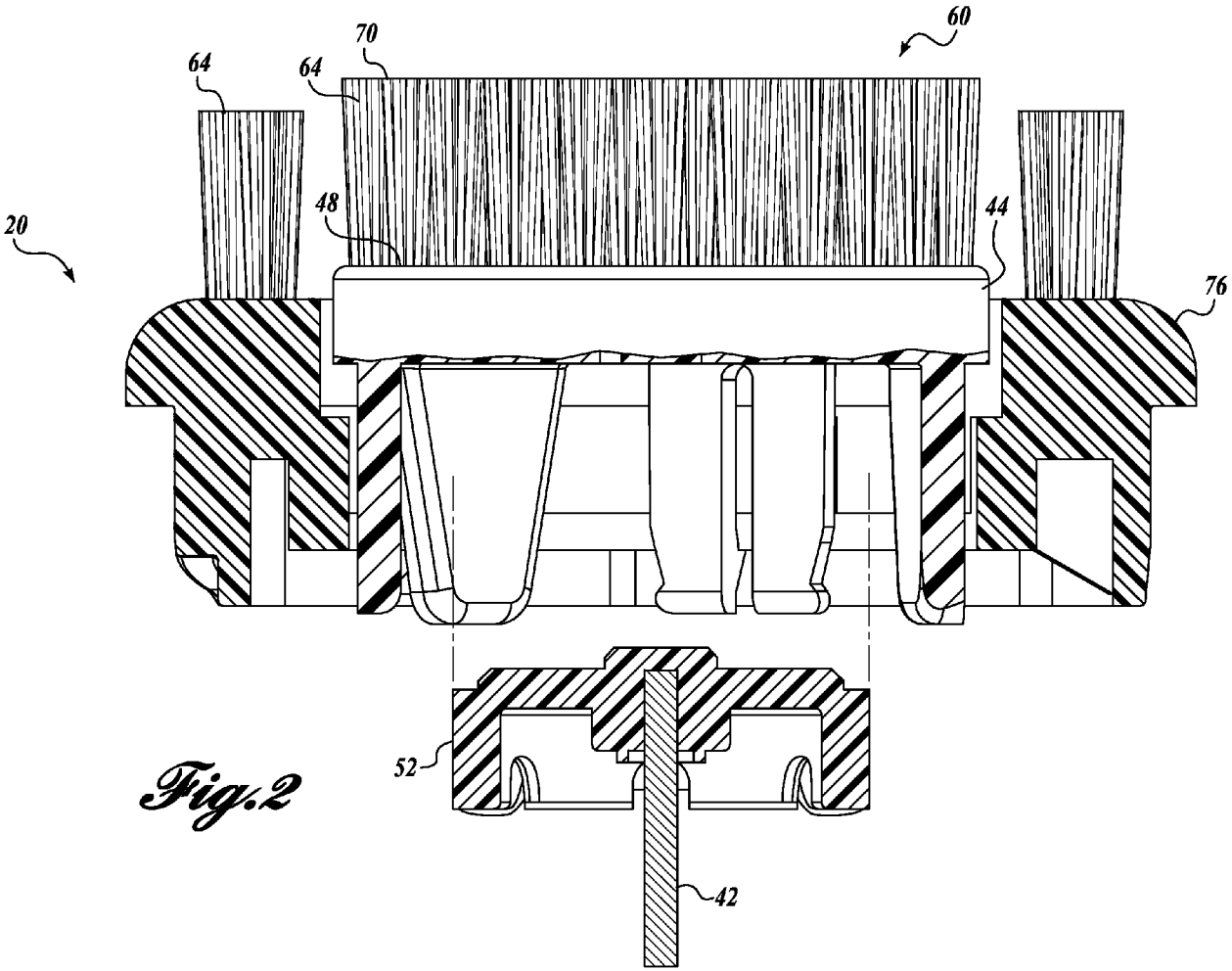
FIG. 2 is a cross sectional view of the brush head of FIG. 1.

Turning now to FIGS. 1-2, one example of the brush head 20 will be described in more detail. As shown in FIG. 2, the brush head 20 includes a body 44 having an outwardly facing outer surface 48. In the embodiment shown, the body 44 has a generally cylindrical cross-section, although other geometrical cross-sections (i.e. triangular, elliptical, lobular, square, etc.) may be employed. The body 44 can be constructed out of plastic, such as nylon, polypropylene, polyurethane, polyethylene, etc., although other materials may be utilized, including lightweight metals, such as aluminum, titanium, etc. In one embodiment, the body 44 includes an elongated cylindrical bore 46, which is oriented perpendicular to the outer surface 48.

The bore includes an opening, (see, e.g., a bore opening 190 in FIGS. 10A and 10B), formed by or disposed at the outer surface 48. As will be described in more detail below, the body 44 can be configured to interface directly or indirectly with a component, such as for example a drive boss 52, of the personal care appliance 22.

The brush head 20 also includes a treatment applicator coupled to outer surface 48 of the body 44 and extending outwardly therefrom. In some embodiments, the treatment applicator is in the form of, for example, a plurality of bristles 64, as shown in FIG. 1. The plurality of bristles 64 can be spaced apart, or in the embodiment shown in FIG. 1, the plurality of bristles 64 can be grouped together (e.g., 20-180 bristles) to form one or more tufts 60. In either case, the bristles 64 extend upwardly from the outer surface 48 of the body 44 and terminate as bristle tips 70. The bristles 64 in some embodiments of the present disclosure have a length of about 0.20 inches (5.08 millimeters) to about 1.2 inches (30.48 millimeters) or greater and a diameter in the range of about 0.002 inches (0.0508 millimeters) to about 0.020 inches (0.508 millimeters) or greater. In one embodiment, the diameter of the bristles 64 is in the range of about 0.002 inches (0.0508 millimeters) to about 0.005 inches (0.127 millimeters). In some embodiments, one group of bristles can have a longer length than another group of bristles.

One example of a brush head with bristles of lengths is described in co pending U.S. application Ser. No. 13/862280, filed Apr. 12, 2013 U.S. Pat. No. 9,107,486, issued Aug. 18, 2015.

The bristles 64 can be constructed out of a variety of materials, including but not limited to elastomers, co-elastomers, polymers, co-polymers, and blends or combinations thereof, etc.

In some embodiments, one or more of the bristles 64 may be constructed out of polybutylene terephthalate (PBT) polyester or a TPE/PBT blend, such as DuPont™ Tynex®, Supersoft Hytrel® thermoplastic elastomer filaments or DuPont™ Natrafil® polyester with texturing additives with high performance suitable for sonic applications. Filaments with differing bending and ink adhesion characteristics, such as DuPont™ Tynex® nylon of differing blends (i.e. 6, 6.10, 6.12 etc.), can be also be selected depending on its intended application and desired adhesion characteristics, as will be discussed in more detail below. Other DuPont™ Tynex® nylon may be employed to construct the filaments, including DuPont™ Tynex® PTFE. DuPont™ Tynex® PTFE is Nylon 6.12 (i.e. 0906) loaded with an additive to provide a slippery feel, which again provides another adhesion variable suitable for the inner, intermediate, or outer material layers, as will be discussed below. In other embodiments, the bristles can be constructed out of or include an elastomer. One such example includes an elastomeric (e.g., TPE) inner core and a polymer (e.g., PBT) outer jacket. Although DuPont materials are mentioned herein with their trade names, it is understood that generic equivalents and variations may be suitable for use also, such as; polypropylene, polyethylene, such as DuPont™ Bynel®, with combinations or blends thereof, etc.

In some embodiments, the bristles 64 may have cross sections including but not limited to solid round, hollow, rectangular, diamond, hollow, rectangular, X-shape, quadralobal, including textured surface etc. Additives may be added that can either enhance sonic resonance characteristics, or provide extra benefits such as silver zeolite for antibacterial effects. Additives may also be used to modify the surface energy of the filaments and control the surface energy, as will be described in more detail below.

Still referring to FIG. 2, the brush head 20 in some embodiments may also include an optional outer retainer 76. The outer retainer 76 forms a central, cylindrically shaped opening that is sized and configured to surround the body 44. In some embodiments, a plurality of bristles 64 extend from the outer surface of the outer retainer 76. In yet other embodiments the retainer 76 may be absent of bristles (e.g., filaments) and have a more decorative design. The body 44 and the outer retainer 76 together include an attachment system in some embodiments that is configured to provide selective attachment of the brush head 20 to the personal care appliance 22.

Figure 5:
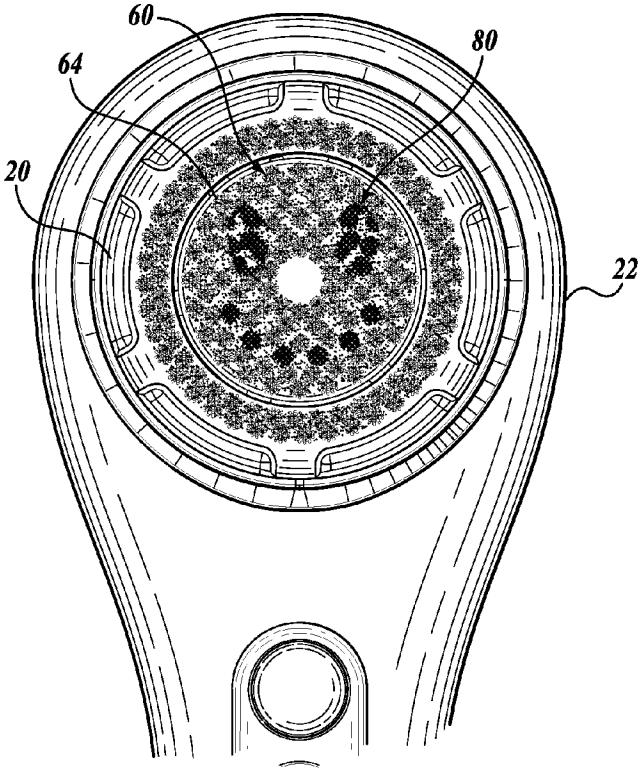
FIG. 5 is a is a top view of the brush head coupled to a personal care appliance of FIG. 3 wherein the wear or replacement indicator has faded and/or partial removed over time based on use of the brush head.
Figure 4:
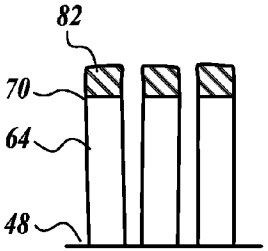
FIG. 4 is an enlarged schematic view of a plurality of bristles, each bristle having a material layer disposed thereon in the form of a wear or replacement indicator.

As briefly described above, the brush head 20 further includes a wear or replacement indicator 80, as shown in FIG. 1. In the embodiment shown in FIGS. 3-5, the wear indicator 80 includes a colored material layer 82 (see FIG. 4) disposed on a plurality of bristles 64, tufts 60, or portions thereof. The colored material layer 82 can be printed, dipped, painted or otherwise applied to the bristle tips 70 in one or more sections the brush head. In that regard, the material layer 82 in some embodiments can be in the form of picture, such as a flower, a pattern, such as a ring, or indicia, such as symbols, letters, numbers or words, among others. In other embodiments, the colored material layer 82 can be a solid color, such as for example, white, red, blue, etc.

In some embodiments, the material layer 82 can be configured to wear or fade, thereby indicating a need for replacement. In other embodiments, the material layer 82 can be configured to wear or fade, which can reveal the color of the substrate, such as the bristles 64, body 44, etc., thereby indicating a need for replacement. In some embodiments, fading can be caused by abrasion against the skin or hair of a subject. Additionally or alternatively, fading can be based on its interaction with a liquid, such as for example, water, cleansing agents, skin care formulations, etc. In some these embodiments, the material layer 82 can include a polyvinyl alcohol, such as Elvanol, and can be, for example, approximately <0.1 mm thick. Further still, fading can be caused by a loss of or diminishing adhesion between the material layer 82 and the underlying substrate, for example, the bristle tips 70.

Figure 6:
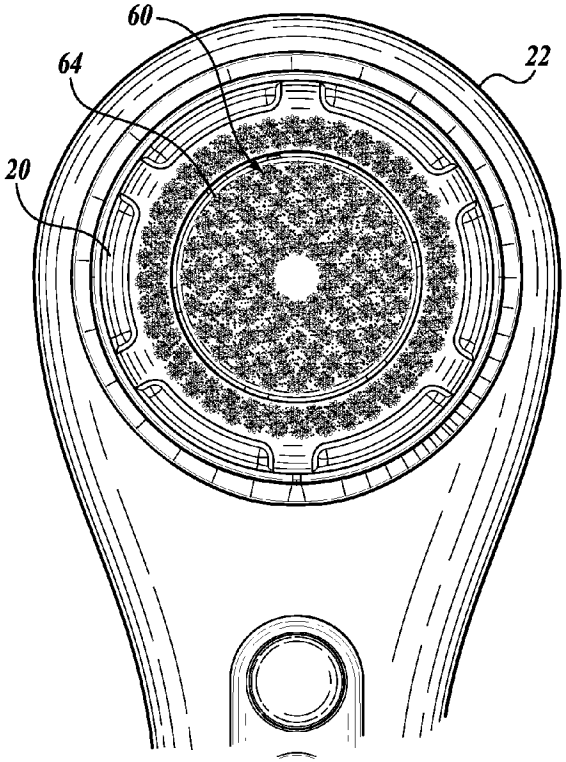
FIG. 6 is a top view of a brush head coupled to a personal care appliance, the brush head having another example of a wear or replacement indicator in accordance with aspects of the present disclosure.
Figure 7A:
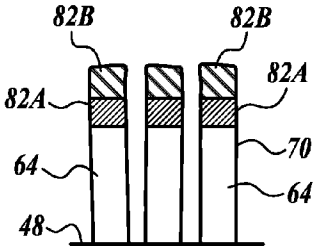
FIGS. 7A-7B are enlarged schematic views of a plurality of bristles, each bristle having an inner material layer and an outer material layer disposed thereon forming a wear or replacement indicator.

In accordance with another aspect of the present disclosure, the wear indicator 80 can be comprised of multiple layers 82A, 82B disposed on the plurality of bristles 64, tufts 60, or portions thereof. In the embodiment shown in FIGS. 6-8, a first material is printed, dipped, painted or otherwise applied to the bristle tips 70 on one or more sections of the brush head to form a first or inner material layer 82A. In that regard, the first material layer 82A can be in the form of or include a symbol or words indicating a need for brush head replacement. In the embodiment shown, the first or inner layer 82A forms an "X" symbol, which can be revealed to depict, for example, a universal symbol to replace the brush head. In another embodiment, inner layer 82A may spell out a word, such as for example "REPLACE," as an instructional message to the user. A second material is then printed, dipped painted or otherwise applied to at least cover the first or inner material layer 82A, thereby forming a second or outer material layer 82B. Once applied, the second or outer material layer 82B hides or obfuscates the message or indicator formed by the first or inner layer 82A. In some embodiments, the second or outer layer 82B can be a solid color, such as red, blue, green, etc., a covering pattern, a picture, etc.

In these embodiments, the material of the first or inner material layer 82A can be chosen so as to achieve near permanent adhesion and resistance to wear. Examples of materials that can be used to form the material layer 82A are acrylated monomers, acrylated oligomers, amine acrylates, acrylic esters, just to name a few. These materials can be UV curable. In some embodiments, the material layer 82A can be formulated as a printable ink so as to be applied to the bristle tips 70 of the brush head 20 via a commercially available inkjet type printer. It will be appreciated that other application techniques, including painting, dipping, etc., can be employed to apply the material in order to form the material layer 82A.

In some embodiments, the material layer 82B can be configured to wear or fade, which can reveal the color of the substrate, such as the first material layer 82A, etc., thereby indicating a need for replacement. In some embodiments, fading can be caused by abrasion against the skin or hair of a subject. Additionally or alternatively, fading can be based on its interaction with a liquid, such as for example, water, cleansing agents, skin care formulations, etc. In some these embodiments, the material layer 82 can include a polyvinyl alcohol, such as Elvanol, and can be, for example, approximately <0.1 mm thick. Further still, fading can be caused by a loss of or diminishing adhesion between the material layer 82B and the underlying substrate, for example, the material layer 82A. In other embodiments, a contaminating layer (not shown) can be disposed in-between the inner and outer layers 82A, 82B to lessen the adhesion therebetween, allowing the outer, second layer 82B to separate from the inner, first layer 82A as the brush head 20 is used over time.

In accordance with another aspect of the present disclosure, the wear indicator 80 can be formed at least in part by the bristle tips 70 or portions thereof in conjunction with a material layer, such as material layer 82 or 82B described above with reference to FIGS. 3-5. For example, in some embodiments, the material layer 82 can be applied to colored or dyed bristle tips 70. In these embodiments, the color of the applied material layer 82 is different than the bristle tips 70. In use, as the material layer 82 wears down, loses adhesion or otherwise fades, etc., the colored bristle tips 70 become visual, indicating to the user a recommendation for brush head replacement. In other embodiments, a select group of bristle tips 70 are colored (e.g., dyed) in order to form a symbol, such as the "X", or a word, such as "Replace," as described above. In these embodiments, the material layer, such as material layer 82 or 82B, overlays the colored bristle tips 70. It should be appreciated that the applied material layer 82 or 82B in these embodiments can have any color so as long as the material layer 82 covers up, hides or obfuscates the colored bristle tips. In use, as the material layer 82 or 82B wears down, loses adhesion, or otherwise fades, etc., the symbol, word, etc., formed by the bristle tips become visual, indicating to the user a recommendation for brush head replacement. It will be appreciated that the bristle tips can be dyed in a conventional manner.

As discuss above, the wear indicator 80 can be configured such that wear is controlled at least in part by the adhesion between the material layer and the bristle tips 70 (e.g., substrate), between inner and outer material layers 82A, 82B, or between the material layer 82 and the body 44. In that regard, one of ordinary skill understands that the surface tension and the comparative surface energy of a material determine the strength of a bond existing between a coating (material layer) and the substrate (e.g., filament material being coated, inner material layer, top surface of body, etc.). If a solid possesses high levels of surface energy as compared to the surface tension of a liquid (i.e. ink, paint, etc.), there will be increased molecular attraction resulting in increased molecular attraction between the ink, paint, etc., yielding a superior bond. To accomplish suitable levels of adhesion for realizing one or more aspects of the present disclosure, the substrate surface energy should range at least 5 mN/m (dyne/cm) above the surface tension of the adhesive, ink, paint, etc., used as the surface coating. In some embodiments, the outer surface 48 of the body 44 can be coated with a specific material layer to advantageously interact with the material layer 82, if desired.

It will be appreciated that controlling the adhesion between the material layer 82 and the substrate (bristle tips 70, inner material layer 82A, body 44, etc.) can be realized simply by the selection of materials used to construct the material layer and the substrate. Varying the substrate surface energy with respect to the surface tension of the material layer 82 via selection of materials allows for varying adhesion strengths, and as a result, provides a means for varying the period of time to reflect, for example, the prescribed use period of a product. In some embodiments, either the bristle 64 or the material layer 82, or both, may carry an additive to help control the amount of adhesion between the filament and the particular ink, paint or coating. In some embodiments, a latex can be mixed with an acrylic formulated ink, which can cause a layering effect within that layer which may be configured to provide an adhesion weakness suitable to promote a bond failure between material layers 82B and 82A. The surface energy difference between acrylic with and without latex may range between 2 dynes/cm and 5 dynes/cm.

It will be appreciated that other techniques may be additionally or alternatively employed to affect the adhesion between materials. For example, various surface treatments to the substrate can be carried out in order to control the adhesion characteristics between the substrate and the material layer (i.e., surface coating). In some embodiments, a surface treatment such as high voltage corona and plasma surface activation can increase the surface energy level making it greater than the surface tension of the coating, printing ink, paint or adhesive so as to increase the chemical attraction. Such techniques may be useful, for example, with low surface energy materials such as High-Density Polyethylene, Polypropylene, EPDM and polyethylene, etc.

In other embodiments, the substrate surface treatments can be in the form of bristle tip finishing techniques, such as for example, end rounding, in order to vary, and thus, control the adhesion characteristics between the material layer 82 and the substrate. For example, the slickness of various materials, such as polypropylene, polyethylene, PTFE treated nylons, etc., can make adhesion extremely difficult in some embodiments because they lack a "tooth" (i.e., a mechanical interface that includes pits, grooves, channels, or other 3D texture), for the material layer to adhere to. Accordingly, the bristle tips 70 can be treated in order to form a preselected degree of tooth for the material layer to adhere to for a selected period of time. In some embodiments, the treatment reduces the degree of tooth of the substrate, while in other embodiments, the treatment increases the degree of tooth of the substrate. In some embodiments, both the selection of materials and substrate surface treatment is employed in order to provide adhesion for a selected period of time.

Accordingly, one or more adhesion factors when controlled provides a technique or means for allowing material layers, which can be, for example, printed, dipped, painted or otherwise applied paints, inks, etc., to wear (e.g., rub off, fade, or be removed, etc.) over time. This capability can be advantageously utilized to provide an indication of wear by revealing a substrate yielding a recognizable symbol, word, color, etc., indicative of brush replacement. This capability can also be advantageously utilized to provide an indication of wear by triggering a mechanical "pop-up" device to signal brush replacement to the user, as will be described in various examples below.

Figure 7B:
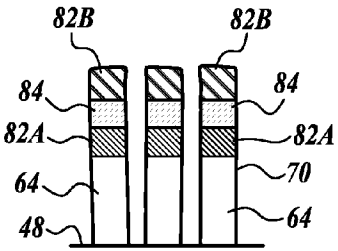
Figure 8:
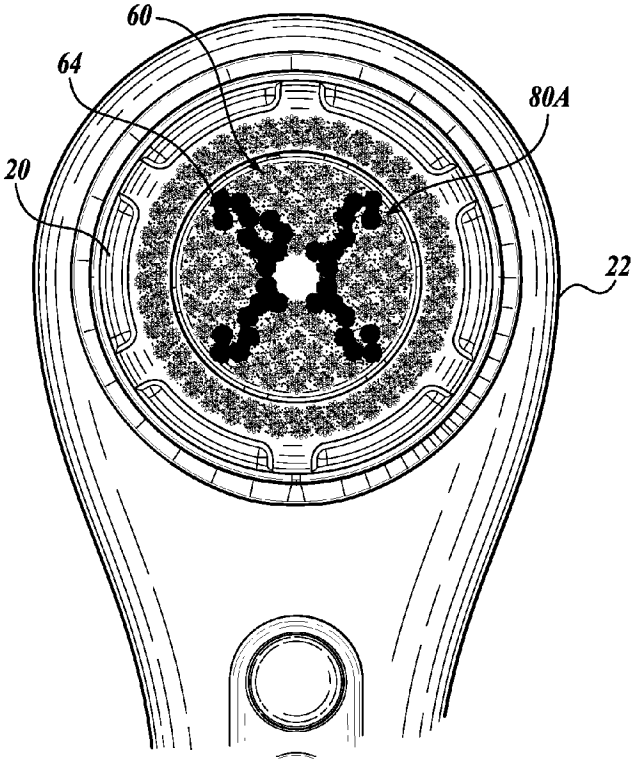
FIG. 8 is a top view of the brush head coupled to a personal care appliance of FIG. 6 wherein the outer layer has been removed over time via use in order to show the inner material layer which provides an indication that the brush head is in need of replacement.

In some embodiments, the use of an intermediate layer or coating can be optionally employed to provide an adhesion interface for controlling the degree of adhesion. For example, an intermediate layer or coating, such as such latex, oils, including vegetable oil, etc., disposed between the substrate and the material layer can help match the energy levels and provide material layers (e.g., coatings of ink, paint, etc.) that will adhere, yet be capable of removal over time. One example of an intermediate layer 84 is shown in FIG. 7B disposed between material layers 82B (acting as the outer layer) and 82A (acting as the substrate). It will be appreciated that the intermediate layer 84 can also be disposed between the material layer 82 (outer layer) and the bristle 64 (substrate) in FIG. 4.

In one representative embodiment, a UV curable inkjet ink was applied to the monofilament tips of polybutylene terephthalate (PBT) polyester or a TPE/PBT blend, such as DuPont™ Tynex®, Supersoft Hytrel® thermoplastic elastomer filaments. Prior to ink application, the filament tips were treated with an end rounding process in order to provide a suitable surface interface or "tooth" for the initial adhesion to the substrate. In this embodiment, an intermediate layer or coating can be optionally employed to provide an adhesion interface for controlling the degree of adhesion between the UV curable ink and the bristle tips.

In addition to controlling the filament or coating material and/or surface treatment of the substrate in order to control the adhesion effect, other options may also exist. For example, some embodiments may control the wax content of the inks. When the wax content of two inks is similar they may not fully adhere. On the other hand, when one ink is waxy and the other is wax-free, the surface energy is higher and improved adhesion is created. In other embodiments, the carrier fluid in the inks can be adjusted (e.g., reduced). This may cause an incompatibility between the ink and the substrate, even though the ink may be formulated for the specific type substrate. This enables the applied ink to be more easily scratched off to reveal the substrate below. Additionally, the use of solvent based inks and water solvent inks may also be used to control the desired surface energy. Further, when the substrate energy is increased using plasma treatment, the first layer of ink is also strengthened. By not treating the first layer of applied ink, the interlayer bond between the first layer and the second layer of ink will have reduced adhesion, thus making the outer ink layer easier to be removed.

Inkjet inks that represent some examples of the types of materials discussed herein are manufactured by Pad Print Machinery, East Dorset, Vt. (i.e. PLTIJ-CJ #60 White, #65 Black, #1 Cyan, #2 Magenta, and #3 Yellow). Equipment for application of these and other inks are also commercially available from provided by Pad Print Machinery. Although these specific inks and equipment are utilized for the samples, other inks and equipment are suitable for embodiments of the present disclosure.

Figure 9:
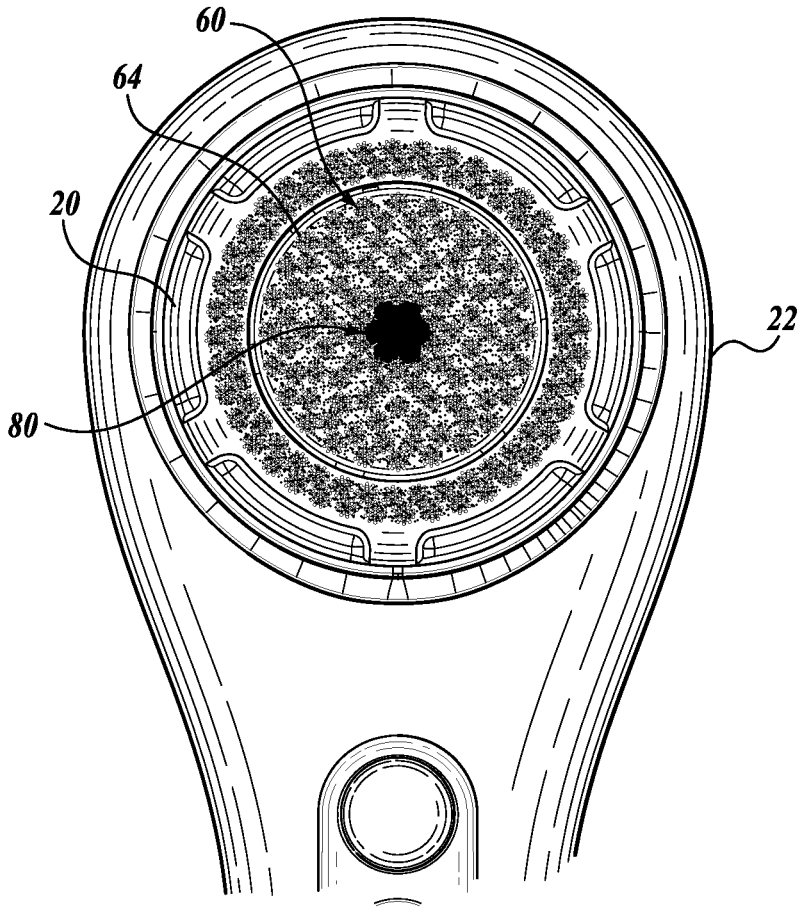
FIG. 9 is a top view of another example of a brush head having a wear or replacement indicator in accordance with aspects of the present disclosure.

While the embodiments of the wear or replacement indicator 80 described thus far have been disposed on the bristles 64 of the brush head 20, other embodiments of the brush head 20 are contemplated. For example, components of the wear indicator 80, such as material layer 82 or material layers 82A, 82B, can be printed, painted, coated, or otherwise applied directly or indirectly to one or more sections (e.g., central area, etc.) of the outer surface 48 of the body 44, as best shown in FIG. 9, or employed in a mechanical "pop-up" device, as shown in FIGS. 10A-12B. In these or other embodiments, one or more of the wear factors can be controlled, including by specifically selecting the material or materials for the body, the top surface thereof, and/or the material layers in order to achieve the desired wear patterns vs. time relationship in accordance with aspects of the present disclosure.

Figure 10A:
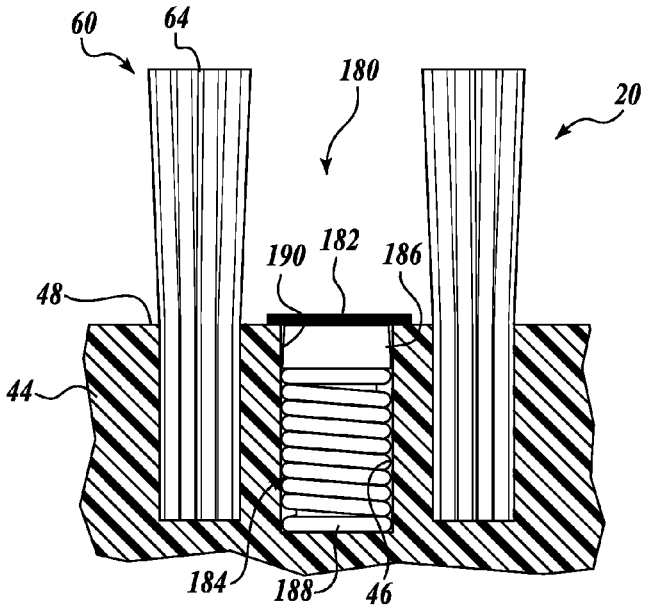
FIGS. 10A-10B are partial cross sectional views of a brush head that includes another example of a wear or replacement indicator in accordance with aspects of the present disclosure.
Figure 10B:
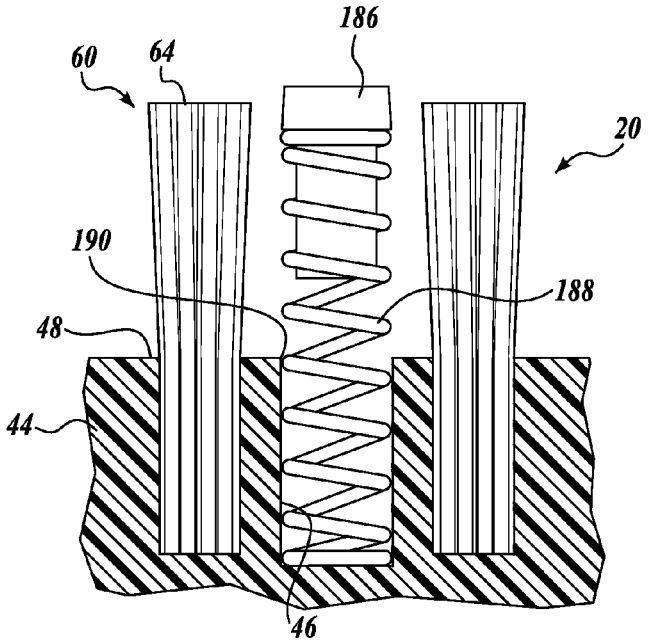

FIGS. 10A-10B illustrate another example of a wear or replacement indicator, generally designated 180, in accordance with another aspect of the present disclosure. As shown in FIG. 10A, the replacement indicator 180 includes a mechanical "pop-up" device 184 formed in one embodiment by a wear layer 182, a piston-like indicator member 186, and a spring 188. When assembled in the loaded or stowed position of FIG. 10A, the piston-like indicator 186 is loaded into the open ended, elongated cylindrical bore 46 of the body 44 against the biasing force of the spring 188, and is retained therein by the wear layer 182. In the embodiment shown, the wear layer 182 is disposed across the top of the member 186 and portions of the outer surface 48 of the body 44 that surround bore opening 190. In some embodiments, the wear layer 182 can be mounted to or otherwise affixed over the opening 190 via adhesive, heat bonding, etc. In other embodiments, the wear layer 182 can be printed over the opening 190 with the aid of an intermediate layer (not shown). When first applied over the opening 190, the wear layer 182, either alone or in conjunction with the intermediate layer, is configured to overcome the biasing force of the spring 188.

During use of the brush head over time, the wear layer 182 (and possibly the adhesive if employed) begins to wear, either via abrasion, loss of adhesion, solubility, etc., or combinations thereof. As the wear layer 182 wears over time, the wear layer 182 becomes weaker, providing less resistance against the biasing force of the spring 188. Once the layer 182 weakens to a point that it can no longer overcome the biasing force of the spring 188, the biasing force of the spring 188 forces the piston-like indicator 186 through the layer 182 and into a deployed position shown in FIG. 10B. As such, the wear layer 182 acts like a trigger mechanism, causing the piston-like indicator 186 to be released from its loaded or stowed position. In its deployed or replacement signaling position, the piston-like indicator 186 is visible to the user, thereby indicating to the user a recommendation that the brush head be replaced. In some embodiments, the top of the piston-like indicator 186 is adjacent the top of the bristles 64, and in some embodiments, the top of the member 186 extends outwardly of the bristles 64. To increase visibility of the piston-like indicator 186, the upper section of the piston-like indicator 188 can include a solid color, such as red. It will be appreciated that the wear layer 182 may also be formed out of oxo-biodegradable plastics, biobased polymers, etc., blends, and/or derivatives thereof, as will be described in other embodiments below.

Figure 11:
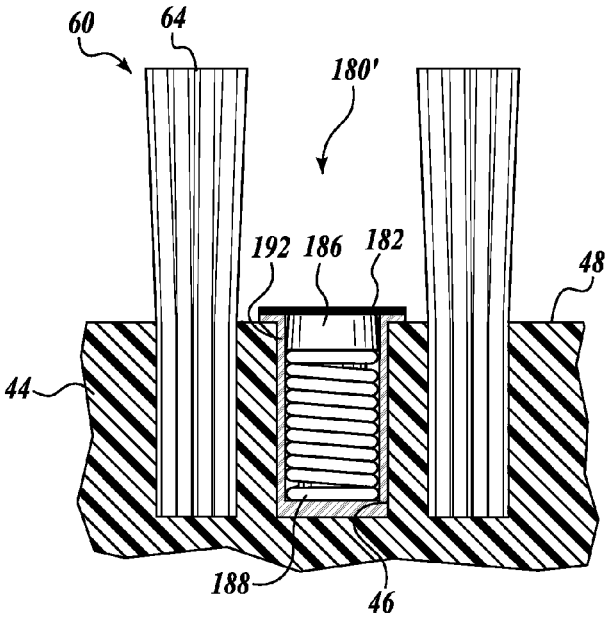
FIG. 11 is a partial cross sectional view of a brush head that includes yet another example of a wear or replacement indicator in accordance with aspects of the present disclosure.
Figure 12:
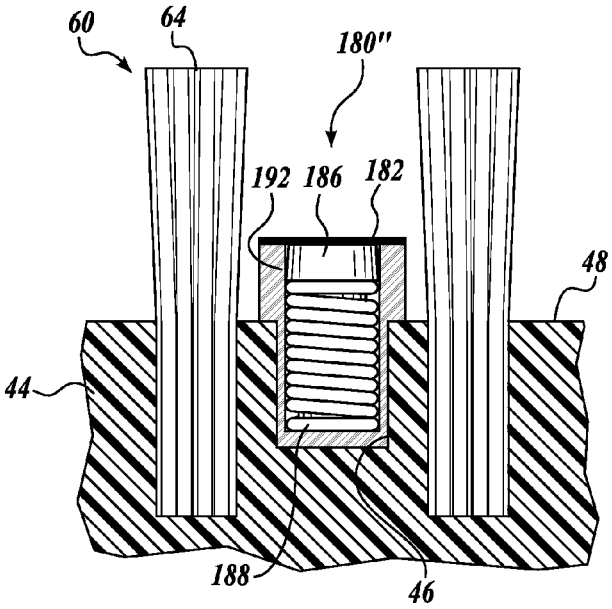
FIG. 12 is a partial cross sectional view of a brush head that includes yet another example of a wear or replacement indicator in accordance with aspects of the present disclosure.

In another embodiment shown in FIG. 11, the "pop-up" device 184 can again be formed by a wear layer 182, a piston-like indicator 186, and a spring or biasing member 188. As shown in FIG. 11, the device 184 further includes a hollow cylindrically shaped insert sleeve 192 that press fits or is otherwise secured into the bore 46 when the brush head is assembled. In this embodiment, the "pop-up" device 184 can be pre-assembled, with the piston-like indicator 186 disposed in the cavity of a hollow cylindrically insert sleeve 192 and biased outwardly against the wear layer 182 via the spring 188. In the embodiment shown in FIG. 11, the insert sleeve 192 is disposed substantially within the bore 46 of the body. However, other configurations are possible, as shown the embodiment of FIG. 12, where a section of the insert sleeve 192 projects outwardly of the outer surface 48 of the brush body 44. In the embodiment of FIG. 12, the travel distance of the piston-like indicator 186 can be smaller than the travel distance of the device of FIGS. 10A-10B and 11, if desired.

Figure 13A:
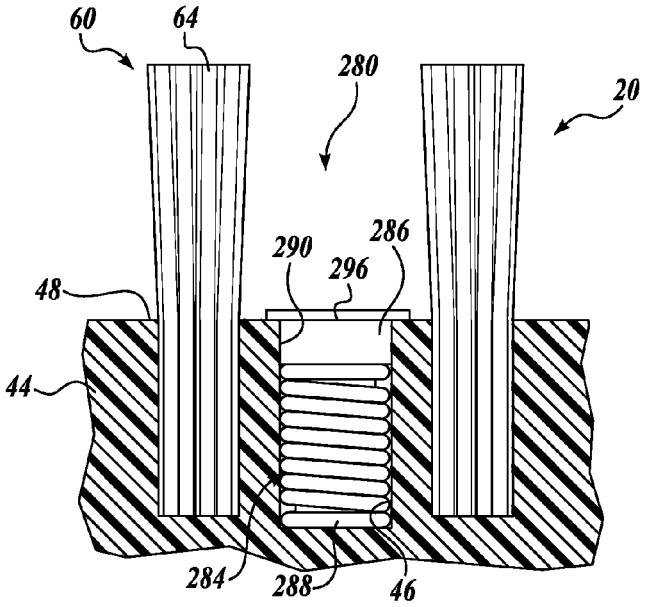
FIGS. 13A-13B are partial cross sectional views of a brush head that includes yet another example of a wear or replacement indicator in accordance with aspects of the present disclosure.
Figure 13B:
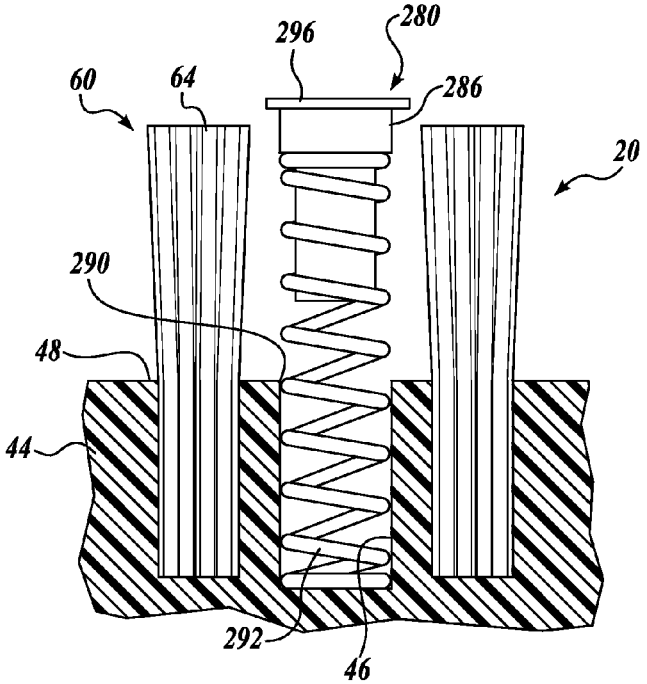

FIGS. 13A-13B illustrate another example of a wear or replacement indicator, generally designated 280, in accordance with another aspect of the present disclosure. The replacement indicator 280 is substantially similar in configuration, materials, and operation as the replacement indicator 180 of FIGS. 10A-10B except for the differences that will now be described. As shown in FIG. 13A, the replacement indicator 280 includes a mechanical "pop-up" device 284.

In this embodiment, instead of the wear layer 182, the piston-like indicator 286 of the device 284 includes an oversized or flanged head 296 that covers up or overlays the opening 290 of the bore 46 (or an opening of an insert sleeve 192 like the one shown in the embodiment shown in 20 FIGS. 11 or 12). In one embodiment, a trigger mechanism in the form of an adhesive configured to lose bonding strength by repeated exposure to water, skin care formulations, etc., can be employed to bond the lower surface of the head 296 directly or indirectly to the outer surface 48 of the brush head 44 (or the top surface of the insert sleeve). Adhesives that lose adhesion over time can also be employed. During use, as the adhesive is either exposed, for example, to water, skin care formulas, etc., or the effects of time when employing a time sensitive adhesive, the bond between the head 296 and the body 44 (or insert sleeve) continually weakens until it can no longer overcome the biasing force of the spring 288. As a result, the biasing force of the spring 288 separates the piston-like device 286 from the body 44 (or the insert sleeve), and moves the device 286 into a deployed or replacement signaling position shown in FIG. 13B.

Figure 14A:
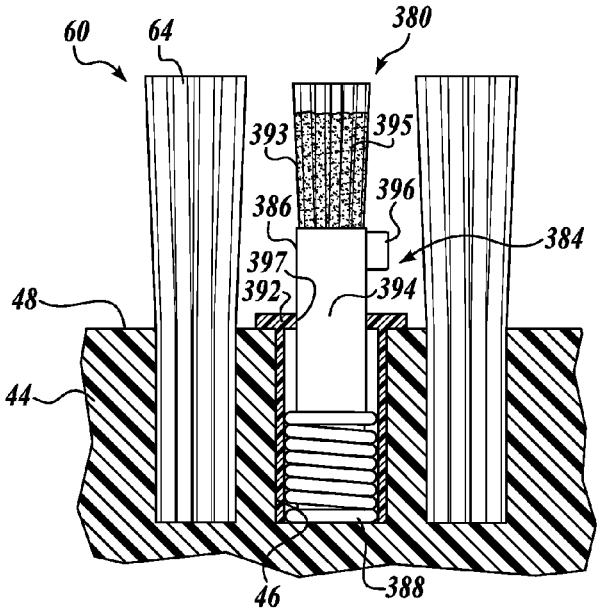
FIGS. 14A-14B are partial cross sectional views of a brush head that includes yet another example of a wear or replacement indicator in accordance with aspects of the present disclosure.
Figure 14B:
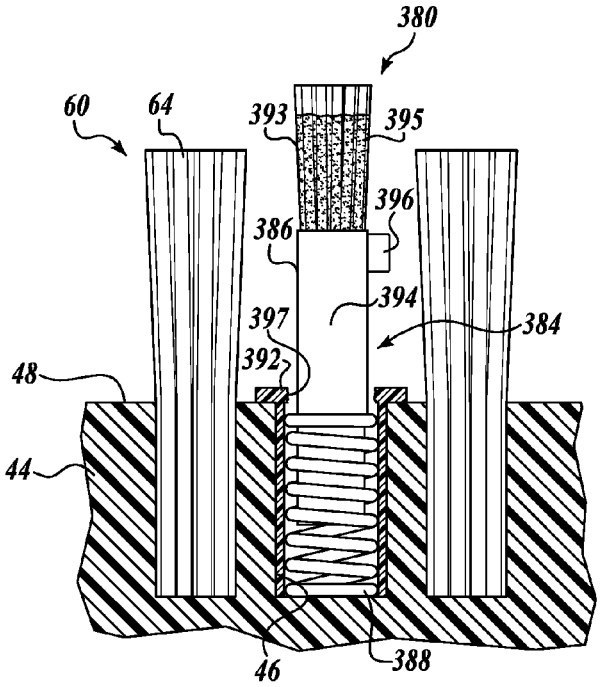

FIGS. 14A-14B illustrate another example of a wear or replacement indictor, generally designated 380, in accordance with another aspect of the present disclosure. As shown in FIG. 14A, the replacement indicator 380 includes a mechanical "pop-up" device 384 formed by a piston-like indicator 386, a biasing member 388, and a retaining insert sleeve 392. In this embodiment, the piston-like indicator 386 can include a plurality of bristles 393 outwardly extending from one end and a cylindrical post 394 inwardly extending from the other end. In one embodiment, sections 395 of the bristles are colored, for example, red for easy signaling. The piston-like indicator 386 in some embodiments may further include a lateral projection 396, the benefits of which will be described in some detail below.

Still referring to FIGS. 14A-14B, the retaining insert sleeve 392 is configured to be inserted or otherwise disposed into the bore 46 of the brush body 44 and securely retained therein (e.g., press fit, adhesive bonding, etc.). As shown in FIG. 14A, the insert sleeve 392 is configured with an elongated cylindrically shaped cavity dimensioned and arranged to freely receive the post 394 of the piston-like indicator 386. The elongated cavity communicates with an opening 397 disposed at the top of the insert sleeve 392, and formed by retaining fingers 398 (See FIG. 15). The opening 397 in one embodiment is generally circular, with a diameter smaller than the elongated, cylindrically shaped cavity, and with a configuration to interface with the post 394. In one embodiment, the retaining fingers 398 project radially inwardly and are configured to retain the outwardly biased piston-like indicator 386 in the loaded position via clamping and/or friction forces. In the embodiment shown in FIG. 15, the fingers 398 are formed by alternatingly angled slits 399, perforations, etc., formed into the top surface of the insert sleeve 392. In one embodiment, the insert sleeve 392 includes a Tinnerman-type opening for forming the retaining fingers 398. Other means for retaining the indicator 386 in the loaded position of FIG. 15A may also be employed.

Figure 16A:
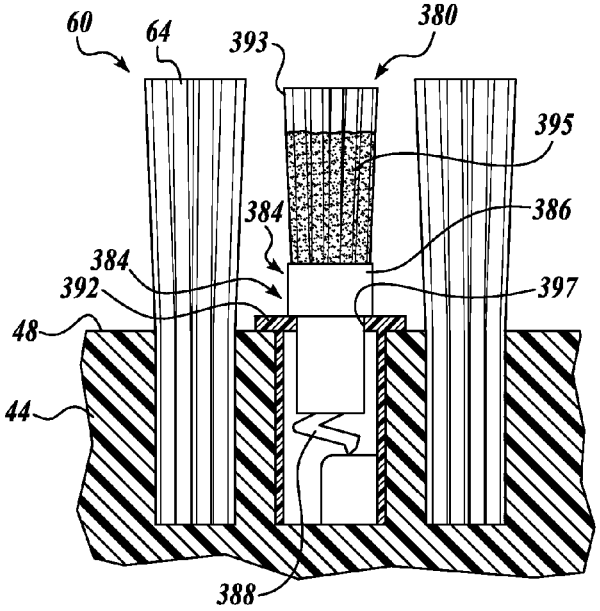
FIGS. 16A-16B are partial cross sectional views of a brush head that includes yet another example of a wear or replacement indicator in accordance with aspects of the present disclosure.
Figure 16B:
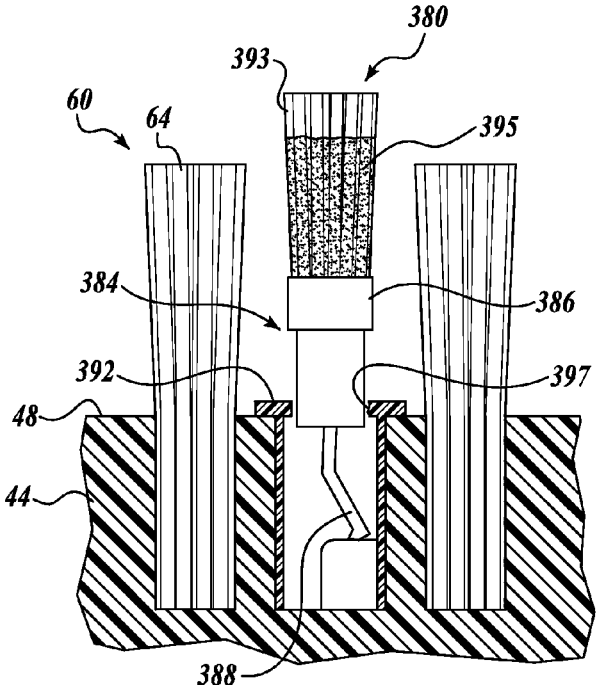

When assembled, the piston-like indicator 384 is positioned such that its post 394 extends through the opening 397 and is partial housed by the elongated cavity. In the stowed or loaded position of FIG. 14A, the piston-like indicator 386 is outwardly biased by the spring or biasing member 388 against the forces of the retaining fingers 398 applied to the side walls of the post 394. In the embodiment shown in FIGS. 14A-14B, the spring or biasing member 388 is a suitably configured coil spring, although other types of springs can be employed, such as leaf springs, Belleville washers, etc. One embodiment of a plastic leaf spring that can be employed is shown in FIGS. 16A-16B, although leaf springs of other configurations may be used. It will be appreciated that in other embodiments, the biasing member 388 can be a block of compressible rubber, TPE, etc., which can also be referred to as springs.

In any of these embodiments, any spring or biasing member 388 can be employed as long as it can create a biasing force for overcoming the forces applied to the piston-like indicator 386 by the fingers 398, as well as cause the piston-like indicator 386 to linearly travel a preselected distance from the stowed or loaded position of FIG. 14A to the deployed or signaling position of FIG. 14B. In some embodiments, the travel distance is between about 1-5 mm. In other embodiments, the travel distance is between about 2 mm and 3 mm.

In accordance with one or more aspects of the present disclosure, the fingers 398, and in some embodiments, the retaining insert sleeve 392, is formed out of oxo-degradable plastics, oxo-biodegradable plastics, bioplastics, sometimes referred generally as biobased polymers, etc., blends, co-polymers, and/or derivatives thereof. As will be described in more detail below, the material characteristics of the fingers 398 of the retaining insert sleeve 392 in some embodiments act like a trigger mechanism, thereby causing the piston-like indicator 386 to be released from its loaded or stowed position. Additionally or alternatively, the piston-like indicator 386 is formed out of oxo-biodegradable plastics, biobased polymers, etc., blends, co-polymers, and/or derivatives thereof. As will be described in more detail below, the material characteristics the piston-like indicator 386 in some embodiments may additionally or alternatively act like a trigger mechanism, thereby causing the piston-like indicator 386 to be released from its loaded or stowed position.

The biobased polymers employed in embodiments of the present disclosure can include one or more of the following: starch based plastics; cellulose based plastics, including cellulose esters and their derivatives, including celluloid; aliphatic polyesters, including by not limited to polylactic acid (PLA), Poly-3-hdroxybutyrate (PHB), Polyhydroxyalkanoates (PHA), etc. In one or more embodiments, the biobased polymers can be used in place of olefin.

In some embodiments, the retaining insert sleeve 392, the fingers 398 thereof, and/or the piston-like indicator 386, is injection molded, blow molded, thermoformed or otherwise formed from a polyolefin resin that includes an oxo-biodegradable additive, such as metal salts, etc. In one embodiment, OxoTerra-M®, an oxo-biodegradable additive from Willow Ridge Plastics, Inc., 3208 Dixie Highway, Eranger, Ky., is mixed with a polyolefin, such as polyethylene, in order to form the retaining insert sleeve. OxoTerra-M® is a non-starch based additive, and uses the oxo-biodegradation process to breakdown the plastic. Time, ambient heat, and/or UV light oxidize the plastic. The process of oxidation reduces the molecular weight and allows for carbon groups to form within the polymer, allowing microorganism to further biodegrade the polymer.

In some embodiments, 1%-3% by weight of additive OxoTerra-M® is added to a polyolefin resin, such as polyethylene, polypropylene, polystyrene, etc., and blends thereof, to provide suitable time degrading properties. It will be appreciated that trigger times can be adjusted by changes in the biasing force of the spring, the percentage of the additive, environmental conditions, etc. In some embodiments, the oxo-biodegradable additive is between approximately 1%-10% by weight, while in other embodiments the oxo-biodegradable additive is between approximately 1%-20% by weight. Other oxo-biodegradable additives, for example PDQ-H or PDQ-M, from Willow Ridge Plastics, Inc., that cause biodegradation to polyolefin may also be employed in some embodiments of the present disclosure.

In other embodiments, the retaining insert sleeve 392, the fingers 398 thereof, and/or the piston-like indicator 386, is injection molded, thermoformed, blow molded, or otherwise formed from Plastarch material (PSM), a biodegradable, thermoplastic resin. In one embodiment, the PSM is sourced from PSM (K) Company Limited, Room 404, $4^{th}$ floor, The Centre Mark, 287-299 Queen's Road Central, Hong Kong. The retaining insert sleeve 392, the fingers 398 thereof, and/or the piston-like indicator 386, may also include other degradable or biodegradable plastics materials described above. These can include but are not limited to a polylactic acid (PLA), a polyhydroxyalkanoate polymer (PHA), such as Mirel® (a bioplastic from Metabolix, Cambridge, Mass.), etc., both of which may be used in place of olefin in many applications.

In the stowed or loaded position, the piston-like indicator 386 is outwardly biased against the forces of the retaining fingers 398 by the spring or biasing member 388. At the same time, the outer ends of the plurality of bristles 393 are below the outer surface of the bristles 64 from between, for example, about 1 mm to 5 mm. During use of the brush over time, the retaining fingers 398, the insert sleeve 392, or portions thereof, of FIGS. 14A and 15 wear via degradation, biodegradation, or otherwise. As a result, retaining fingers 398 apply less force against the post 394 of the piston-like indicator 386, the opening 397 of the insert sleeve becomes larger, or both, providing less resistance against the biasing force of the spring 388. Once the fingers 398 degrade and/or biodegrade to a point that it can no longer overcome the biasing force of the spring 388, the biasing force of the spring 388 forces the piston-like indicator 386 outwardly and into a deployed or replacement signaling position shown in FIG. 14B.

As such, the material characteristics of the retaining fingers 398 and/or the retaining sleeve form a time and/or environmental trigger mechanism in deploying the pop-up device into the deployed or replacement signaling position. In its deployed or replacement signaling position, the bristles 393 are visible to the user, thereby signaling or indicating to the user a recommendation that the brush head be replaced. To increase visibility of the bristles 393, sections 395 of the bristles can include a color, such as red.

In other embodiments where the piston-like indicator 386 includes oxo-biodegradable plastic or bio-based polymers, the piston-like indicator 386 wear via degradation, biodegradation, or otherwise.

As a result, the outer perimeter of the piston-like indicator 386 decreases such the retaining fingers 398 provide less resistance against the biasing force of the spring 388. Once the piston-like indicator 386 degrades to a point wherein the retaining fingers 398 can no longer overcome the biasing force of the spring 388, the biasing force of the spring 388 forces the piston-like indicator 386 outwardly and into a deployed or replacement signaling position.

As briefly stated above, the piston-like indicator 386 may include a projection 396, which alters the inertial characteristics of the replacement indicator 380 when oscillated by the appliance of FIG. 1. As such, the added inertia provides added torque force against the biodegradable retaining fingers 398, providing further degradation or enlargement of the opening 397 during use. The projection may also enable some tuning of the oscillating system to compensate for the use environment and the operating conditions of the brush head. Accordingly, the size and placement of the projection 396 may allow dynamic adjustment for a desired triggering time of the replacement indicator 380. The inertia of the replacement indicator 380 may be altered in other ways, including non-coaxial placement thereof, making the insert sleeve non-concentric or non-symmetric, etc.

Figure 17A:
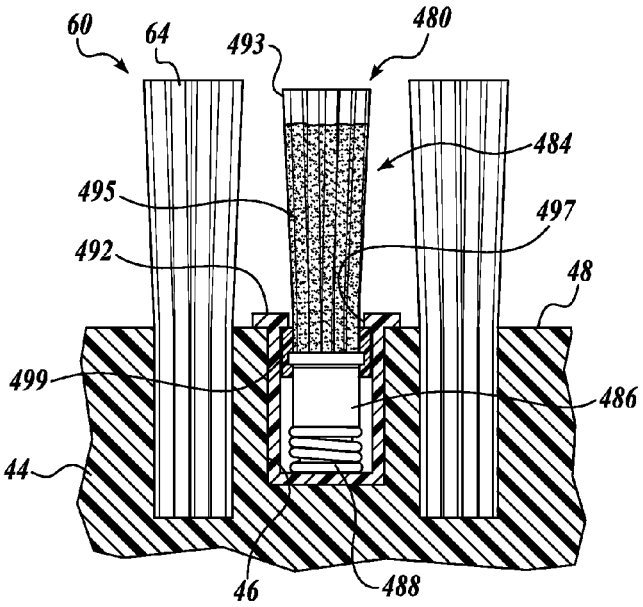
FIGS. 17A-17B are partial cross sectional views of a brush head that includes yet another example of a wear or replacement indicator in accordance with aspects of the present disclosure.
Figure 17B:
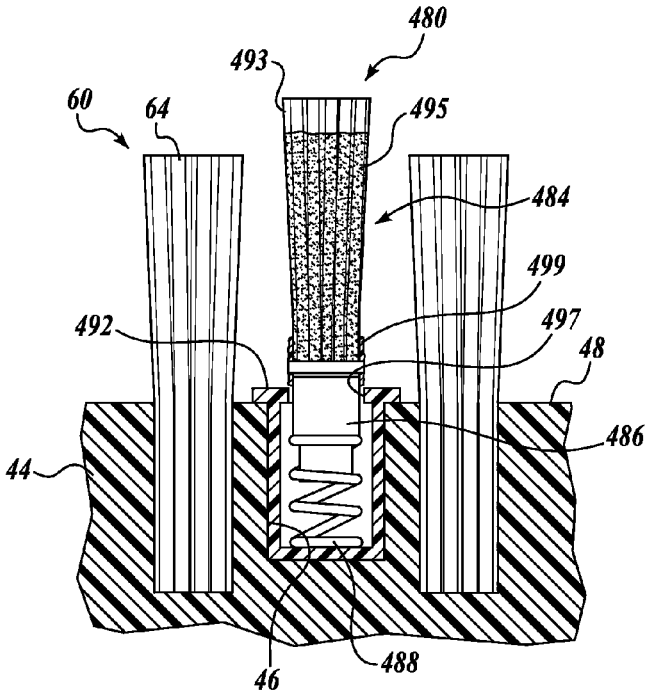

FIGS. 17A-17B illustrate another example of a wear or replacement indicator, generally designated 480, in accordance with another aspect of the present disclosure. The wear indictor 480 is substantially similar in configuration, materials, and operation as the replacement indicator of FIGS. 14A-14B, except for the differences that will described in more detail. As shown in FIG. 17A, the replacement indicator 480 again includes a mechanical "pop-up" device 484 formed by a piston-like indicator 486, a biasing member 488, and a retaining insert sleeve 492. In this embodiment, the piston-like indicator 386 is formed by a ferrule from which a plurality of indicator bristles 493 outwardly extend. In one embodiment, the upper sections 495 of the bristles 493 are colored, for example, red for easy signaling, while in other embodiments, the coloring extends downwardly to the top of the ferrule. In one embodiment, the indicator bristles 493 are inserted into the ferrule and are retained therein by crimping.

The piston-like indicator 486 further includes an outer skirt 499 sized and configured to interface with the opening 497 of the retaining insert sleeve 492. In some embodiments, the outer skirt 499 is formed of an oxo-degradable plastic, an oxo-biodegradable plastic, a biobased polymer, etc. For example, the oxo-degradable plastic, oxo-biodegradable plastic, the biobased polymer, etc., can include any of the materials set forth above with reference to FIGS. 14A-14B. In one embodiment, the outer skirt 499 is formed by overmolding. In another embodiment, the outer skirt 499 is formed by layers of biodegradable plastic tape or film. In yet another embodiment, the outer skirt 499 can be formed by one or more coatings of polyvinyl alcohol, such as Elvanol, dipped, sprayed, brushed, or otherwise applied to the ferrule. In these embodiments, the retaining insert sleeve 492 can be constructed out of conventional plastic, as shown in FIG. 17A. In this embodiment, the opening 497, with or without retaining fingers, is smaller than the outer perimeter of the outer skirt 499. As such, the interface between the outer skirt 499 and the retaining insert sleeve 492 causes the piston-like indicator 486 to be retained in the loaded position. In these embodiments, the material properties of the outer skirt 499 act as a time and/or environmental trigger mechanism to transition the piston-like indicator 486 from the loaded position of FIG. 17A to the deployed or replacement signaling position of FIG. 17B.

Figure 18A:
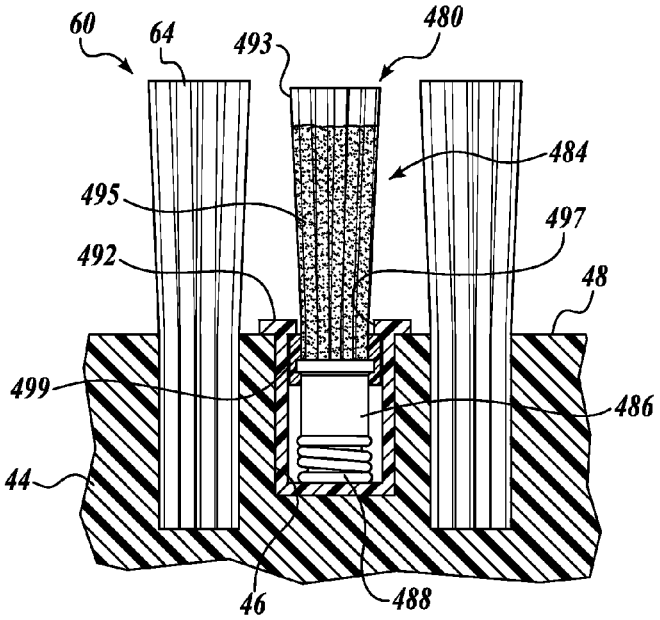
FIGS. 18A-18B are partial cross sectional views of a brush head that includes yet another example of a wear or replacement indicator in accordance with aspects of the present disclosure.
Figure 18B:
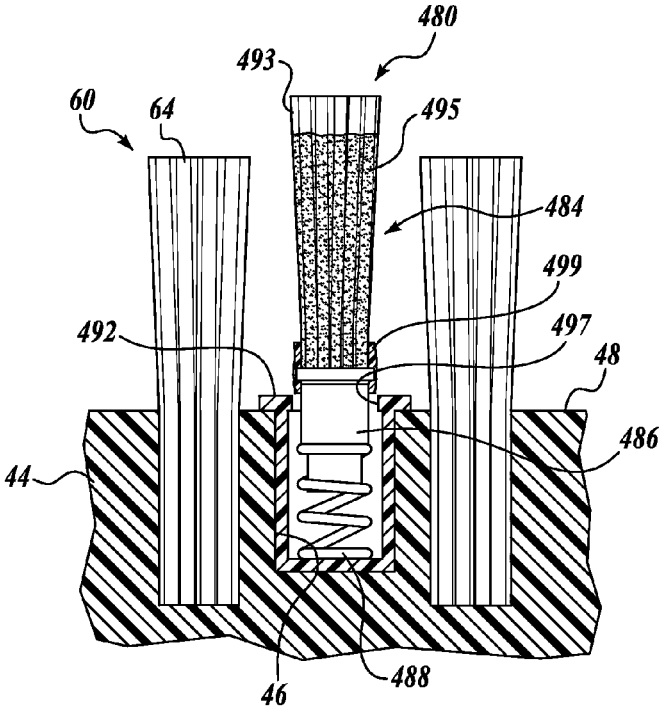

In another embodiment, the retaining insert sleeve 492 can also be constructed of an oxo-degradable plastic, an oxo-biodegradable plastic, a biobased polymer, etc., substantially similar to the retaining insert sleeve 392 of FIGS. 14A-14B, as shown in FIG. 18A. As such, the material properties of the outer skirt 499 in conjunction with the material properties of the retaining insert sleeve 492 act like a time and/or environmental trigger mechanism to transition the piston-like indicator 486 from the loaded positions of FIG. 18A to the deployed or replacement signaling position of FIG. 18B.

While the embodiments of FIGS. 14A-14B, 16A-16B, 17A-17B, and 18A-18B illustrate single stage signaling by the replacement indicators, two stage signaling may also be practiced with one or more embodiments of the present disclosure, including those of FIGS. 14A-14B, 16A-1B, 17A-17B, and 18A-18B.

Figure 19A:
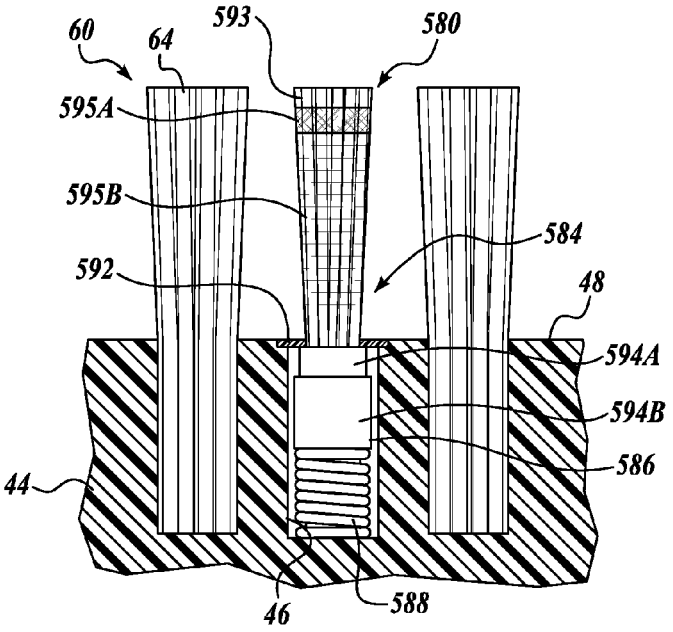
FIGS. 19A-19C are partial cross sectional views of a brush head that include yet another example of a wear or replacement indicator in accordance with aspects of the present disclosure.
Figure 19B:
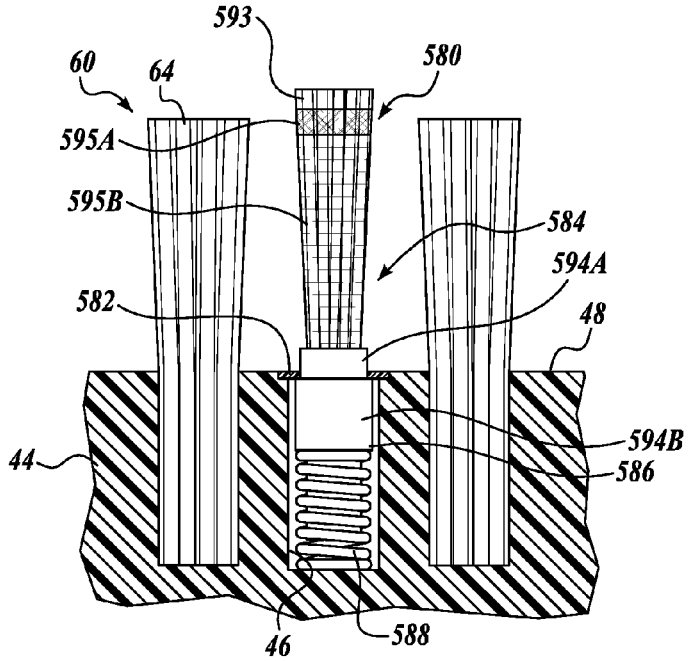

Turning now to FIGS. 19A-19B, there is shown an example of wear or replacement indicator, generally designated 580, with two stage signaling capabilities, in accordance with another aspect of the present disclosure. The wear indictor 580 is substantially similar in configuration, materials, and operation as the replacement indicator of FIGS. 14A-14B, except for the differences that will be described in more detail. As shown in FIG. 19A, the replacement indicator 580 includes a mechanical "pop-up" device 584 formed by a piston-like indicator 586 and a biasing member 588. In this embodiment, the piston-like indicator 586 includes a post with step sections 594A and 594B. Additionally, a retaining plate 592 is employed instead of the retaining insert sleeve 392. Further, the bristles 593 include two different colors, such as yellow section 595A and red section 595B.

Figure 19C:
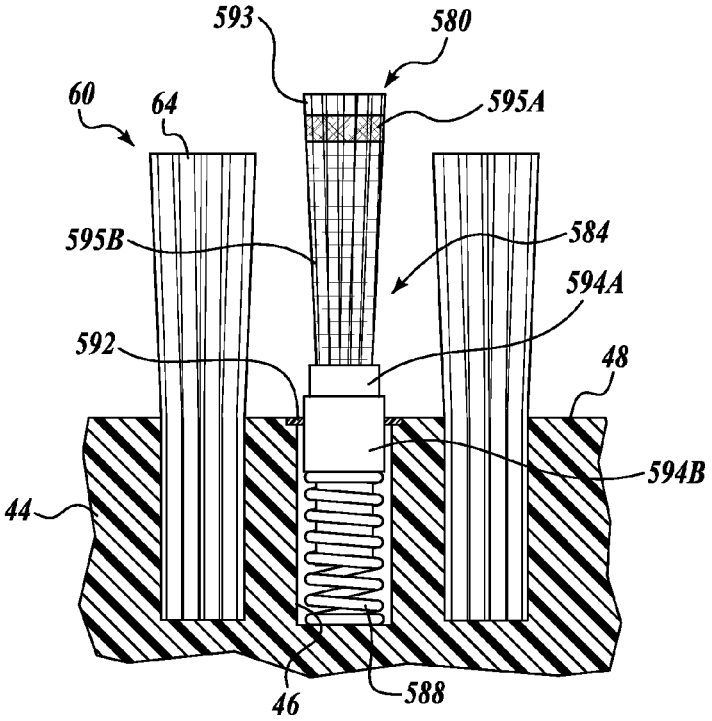
Figure 20:
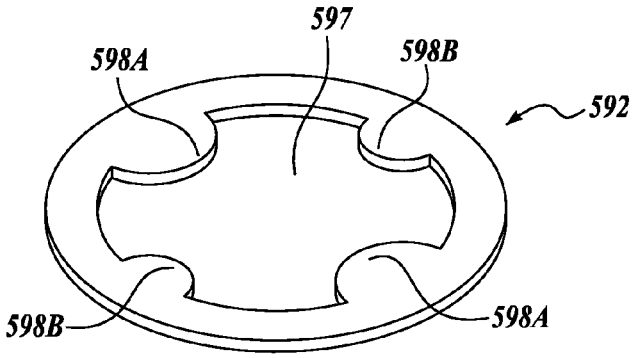
FIG. 20 is a perspective view of one representative example of a retaining insert plate in accordance with aspects of the present disclosure.

Turning now to FIG. 20, the retaining plate 592 will now be described in more detail. As shown in FIG. 20, the retaining plate 592 includes pairs of retaining fingers or projections 598A and 598B. The pairs of retaining fingers or projections 598A and 598B are sized and configured to interface with the post sections 594A and 594B respectively, for retaining the piston-like indicator 586 in either the loaded position of FIG. 19A, or the first signaling position of FIG. 19B. For example, the projections 598A interfaces with the post section 594A to retain the piston-like indicator 586 in the loaded position of FIG. 19A. Over time, the projections 598A degrade, biodegrade, etc., allowing the piston-like indicator 586 to transition to the first signaling position of FIG. 19B, where the projections 598B interface with the post sections 594B. In this position, the user can see the first colored section 595A of the bristles 593, signaling to the user that replacement will soon be needed. Continuing use of the brush will cause the projections 598B to degrade, biodegrade, etc., to a point where they no longer can restrain the piston-like indicator 586. As such, the piston-like indicator transitions from the first signaling position of FIG. 19B to the replacement signaling position of FIG. 19C. In this position, the user can see the second colored section 595B of the bristles 593, signaling to the user that replacement is now needed.

Figure 15:
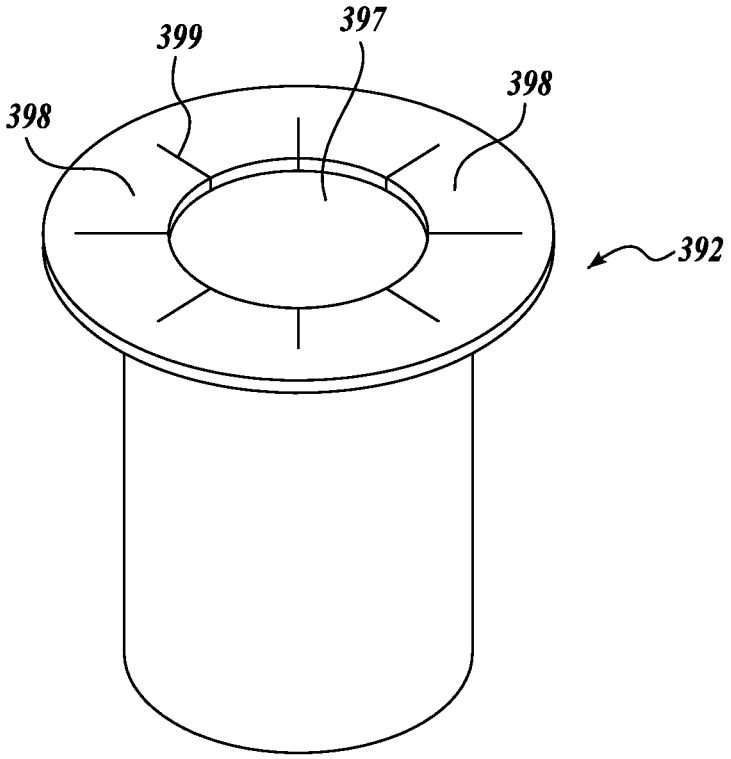
FIG. 15 is a perspective view of one representative example of a retaining insert sleeve in accordance with aspects of the present disclosure.

While the embodiment of FIGS. 19A-19C employed a retaining plate 592 in the configuration shown in FIG. 20, the replacement indicator 580 may also employ either the retaining insert sleeve 392 of FIG. 15 or a retaining plate with an opening/retaining fingers configuration that is substantially similar to the retaining insert sleeve 392 of FIG. 15.

Figure 21A:
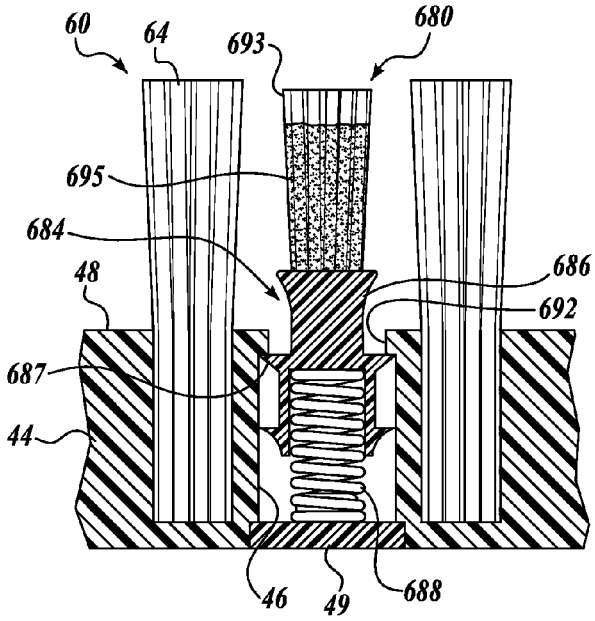
FIGS. 21A-21B are partial cross sectional views of a brush head that includes yet another example of a wear or replacement indicator in accordance with aspects of the present disclosure.
Figure 21B:
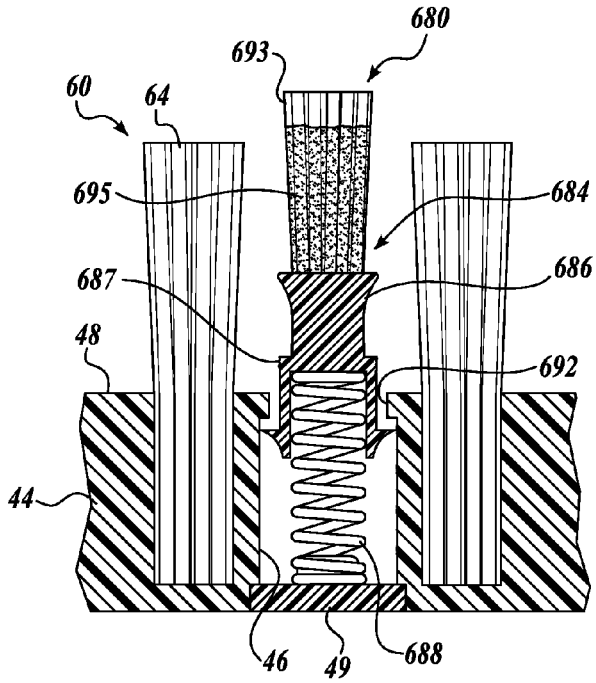

FIGS. 21A-21B illustrate another example of a wear or replacement indicator, generally designated 680, in accordance with another aspect of the present disclosure. The wear indictor 680 is substantially similar in configuration, materials, and operation as the replacement indicator of FIGS. 14A-14B, except for the differences that will be described in more detail. As shown in FIG. 21A, the replacement indicator 680 includes a mechanical "pop-up" device 684 formed by a piston-like indicator 686 and a biasing member 688. In this embodiment, instead of a retaining insert sleeve, the brush body 44 is formed with retaining projections 692, and the device 684 can be assembled from the bottom of the brush body 44 via removable plate 49.

Additionally, the body of the piston-like indicator 686 is formed with projections 687, which interface with the retaining projections 692 of the brush body 44 in order to restrain the piston-like indicator 686 in the loaded position of FIG. 21A. In this embodiment, the piston-like indicator 686, or the projections 687 thereof, are constructed of oxo-degradable plastic, oxo-biodegradable plastic, biobased polymers, etc. Accordingly, once the projections 687 degrade, biodegrade, etc., to a point where they no longer can restrain the piston-like indicator 686 in the loaded position of FIG. 21A, the piston-like indicator 686 is triggered into the deployed or replacement signaling position of FIG. 21B. It will be appreciated that the brush body 44, or the projections 692 thereof, can additionally or alternatively be constructed out of oxo-degradable plastic, oxo-biodegradable plastic, biobased polymers, etc., in order to achieve the time based trigger, and trigger times, desired in selected applications.

Figure 22:
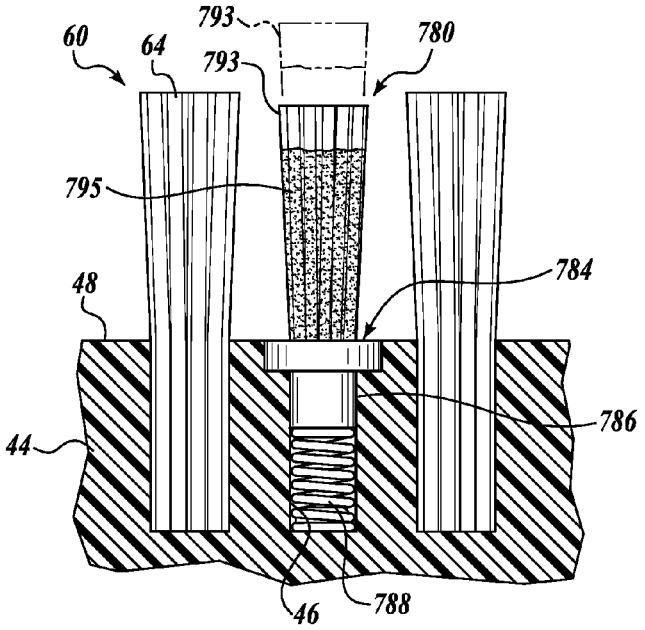
FIG. 22 is a partial cross sectional view of a brush head that includes yet another example of a wear or replacement indicator in accordance with aspects of the present disclosure.

FIG. 22 illustrates another example of a wear or replacement indicator, generally designated 780, in accordance with another aspect of the present disclosure. The wear indictor 780 is shown in the loaded position. As shown in FIG. 22, the replacement indicator 780 includes a mechanical "pop-up" device 784 formed by a piston-like indicator 786 press fit into a countersunk bore 46 of the brush body 44 and outwardly biased by a spring or biasing member 788. In this embodiment, the brush body 44 or the piston-like indicator 786, or both, is constructed out of oxo-degradable plastic, oxo-biodegradable plastic, biobased polymers, etc., such as those described above with reference to FIGS. 14A-14B in order to achieve the time based trigger, and trigger times, desired in selected applications. For example, over time, either the countersunk bore of the brush body 44 gets larger via degradation, biodegradation, etc., and/or the outer perimeter of the piston-like indicator 786 gets smaller via degradation, biodegradation, etc., the piston-like indicator 786 can longer be restrained in the loaded position of FIG. 22. As such, the piston-like indicator 786 is triggered into the deployed or replacement signaling position (the bristles 793 are shown as dashed lines in the replacement signaling position).

Figure 23:
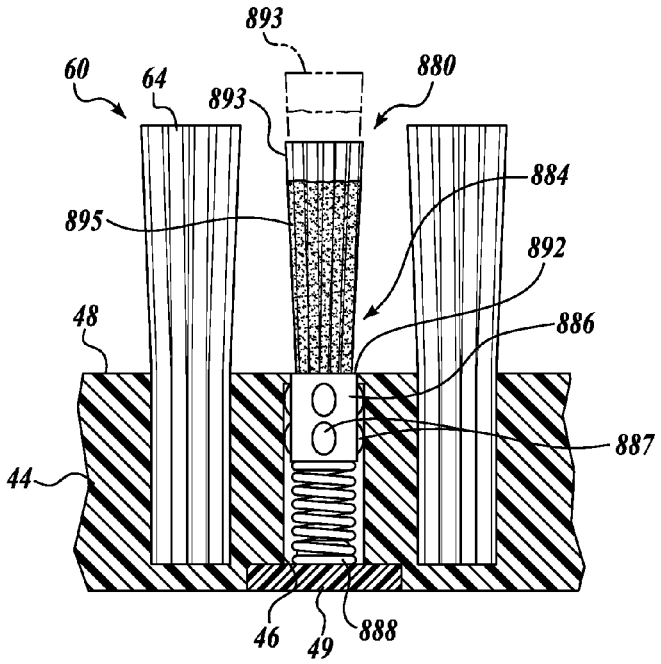
FIG. 23 is a partial cross sectional view of a brush head that includes yet another example of a wear or replacement indicator in accordance with aspects of the present disclosure.

FIG. 23 illustrates another example of a wear or replacement indicator, generally designated 880, in accordance with another aspect of the present disclosure. The wear indictor 880 is shown in the loaded position, and is substantially similar in configuration, materials, and operation as the replacement indicator of FIGS. 21A-21B. FIG. 23 illustrates another example of the configuration of the projections 887. In this embodiment, the projections are shown as bumps, although other configurations are possible as long as they interface with the brush body projections 892 in order to retain the piston-like indicator in the loaded position.

Figure 24:
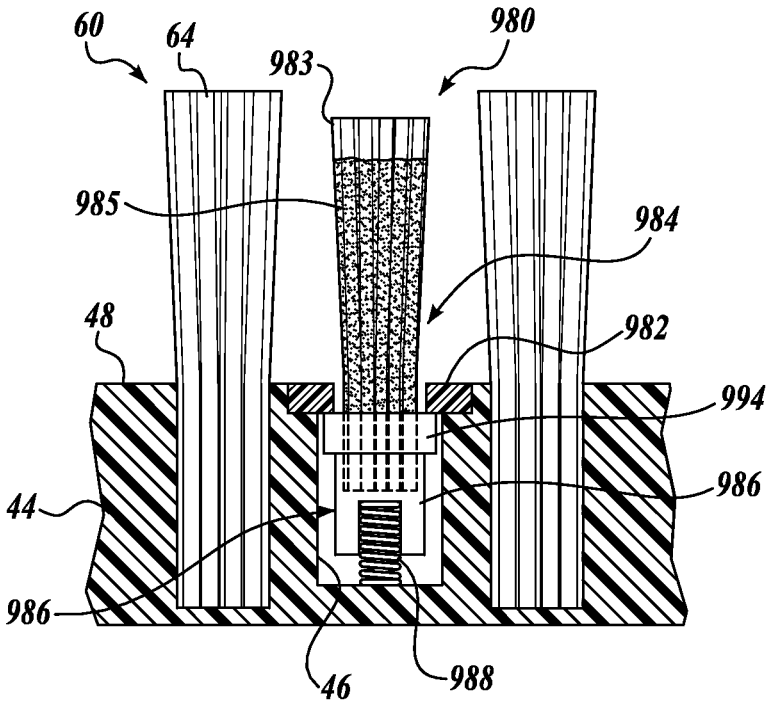
FIG. 24 is a partial cross sectional view of a brush head that includes yet another example of a wear or replacement indicator in accordance with aspects of the present disclosure.

FIG. 24 illustrates another example of a wear or replacement indicator, generally designated 980, in accordance with another aspect of the present disclosure. The wear indictor 980 is shown in the loaded position, and is substantially similar in configuration, materials, and operation as the replacement indicator of FIGS. 14A-14B, except for the differences that will described in more detail. As shown in FIG. 24, the replacement indicator 980 includes a mechanical "pop-up" device 984 formed by a piston-like indicator 986 and a biasing member 988.

In this embodiment, the piston-like indicator 986 includes a post with a stepped section 994. Additionally, a retaining plate 982 is employed instead of the retaining insert sleeve 392. However, in this embodiment, the retaining plate 982 includes an opening/retaining fingers configuration that is substantially similar to the retaining insert sleeve 392 of FIG. 15.

The retaining plate 982 interfaces with the post section 994 to retain the piston-like indicator 986 in the loaded position of FIG. 24. Over time, the retaining fingers of the retaining plate degrade, biodegrade, etc., and/or the opening enlarges, allowing the piston-like indicator 986 to transition to the replacement signaling position (only the bristles 983 are shown as dashed lines in FIG. 24).

As stated above, examples of the brush head 20 are suitable for use with a personal care appliance. In that regard, one example of a personal care appliance 22 that may be employed to impart an oscillating motion to the workpiece 20 will be described in some detail. While the personal care appliance 22 is one type of appliance that can be practiced with embodiments of the present disclosure, it will be appreciated that the workpiece 20 is suitable for use with a wide range of oscillatory, rotational, and reciprocating motion generating devices.

Figure 25:
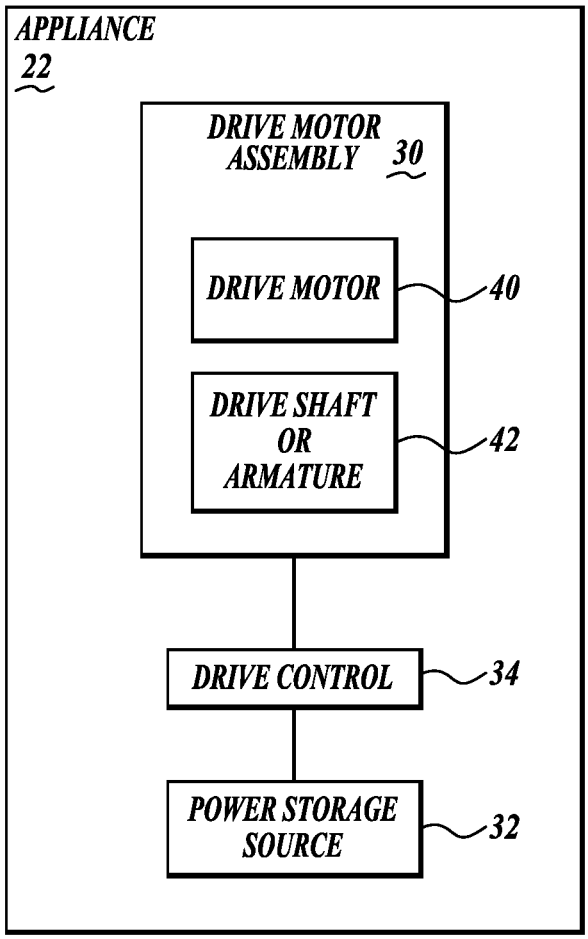
FIG. 25 illustrates in block diagrammatic form one example of the personal care appliance.

Turning now to FIGS. 1, 2, and 25, there is shown one example of the personal care appliance 22. The appliance 22 includes a body 24 having a handle portion 26 and a head attachment portion 28. The head attachment portion 28 is configured to selectively attach a workpiece or head, such as brush head 20, to the appliance 22. The appliance body 24 houses the operating structure of the appliance. As shown in block diagrammatic form in FIG. 12, the operating structure in one embodiment includes a drive motor assembly 30, a power storage source 32, such as a rechargeable battery, and a drive control 34 that includes an on/off button 36 (See FIG. 1) configured and arranged to selectively deliver power from the power storage source 32 to the drive motor assembly 30. In some embodiments, the drive control 34 may also include a power adjust or mode control buttons 38 (See FIG. 1) coupled to control circuitry, such as a programmed microcontroller or processor, which is configured to control the delivery of power to the drive motor assembly 30. The drive motor assembly 30 in some embodiments includes an electric drive motor 40 that drives the brush head 20, via a drive shaft or armature 42 and drive boss 52.

When the brush head 20 is mounted to the head attachment portion 28, the drive motor assembly 30 is configured to impart motion to the brush head 20. The drive motor assembly 30 may be configured to operate the brush head 20 at sonic frequencies, typically in the range of 40-350 Hz, oscillating the brush head 20 back and forth within a range or amplitude of 3-45 degrees. In some embodiments, as will be described in more detail below, the brush head 20 can be operated in loaded or unloaded conditions at frequencies from about 80 Hz to about 220 Hz and with a range or amplitude of about 6 degrees to about 20 degrees. It will be appreciated that the operation frequency and oscillation amplitude imparted to the cleansing workpiece 20 by the drive motor assembly 30 could be varied, depending in part on its intended application and/or characteristics of the brush head, such as its inertial properties, etc.

It should be noted that for purposes of this disclosure, terminology such as "upper," "lower," "vertical," "horizontal," "inwardly," "outwardly," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. The terms "about," "approximately," etc., mean plus or minus 5% of the stated value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A workpiece for use with a motorized personal appliance, comprising:

a body having an outer surface;

a treatment applicator coupled to the outer surface of the body, wherein the treatment applicator is configured to apply treatment to a subject's skin; and a replacement indicator including an indicator member configured to move to a replacement position with respect to the treatment applicator after an amount of usage of the workpiece has occurred, wherein the replacement position indicates to a user a recommendation for replacement of the workpiece, wherein the replacement indicator further includes a biasing member and a retainer, wherein the indicator member is configured to be moved to a loaded position against a biasing force of the biasing member, and wherein the indicator member is restrained in the loaded position via the retainer.

2. The workpiece of claim 1, wherein the replacement indicator further includes a trigger mechanism configured to release the indicator member and allow the indicator member to transition from the loaded position to the replacement position under the biasing force of the biasing member.

3. The workpiece of claim 2, wherein the trigger mechanism is configured to trigger the release of the indicator member based on time or environmental conditions.

4. The workpiece of claim 1, wherein the retainer is configured to trigger the release of the indicator member and allow the indicator member to transition from the loaded position to the replacement position under the biasing force of biasing member.

5. The workpiece of claim 4, wherein the retainer includes at least one of an oxo-degradable plastic, an oxo-biodegradable plastic, a biobased polymer.

6. The workpiece of claim 1, wherein the indicator member is configured to trigger the release of the indicator member and allow the indicator member to transition from the loaded position to the replacement position under the biasing force of the biasing member.

7. The workpiece of claim 6, wherein the indicator member includes at least one of an oxo-degradable plastic, an oxo-biodegradable plastic, a biobased polymer.

8. The workpiece of claim 1, wherein the treatment applicator includes a plurality of bristles.

9. The workpiece of claim 8, wherein the indicator member extends past the plurality of bristles in the replacement position.

10. The skin brush head of claim 8, wherein the plurality of bristles each having a free end, and wherein the indicator member is configured to move in the direction of the free ends of the plurality of bristles.

11. The workpiece of claim 1, wherein the indicator member includes a laterally extending projection configured to alter the inertia of the replacement indicator.

12. A removable workpiece for use with a motorized personal appliance, comprising:

a body having an outer surface;

a treatment applicator coupled to the outer surface of the body, wherein the treatment applicator is configured to apply treatment to a subject's skin; and a workpiece replacement recommendation indicator movable from a loaded position, in which the indicator is outwardly biased by a spring against a retainer, and a replacement recommendation position in which the indicator is adjacent an outer end of the treatment applicator; and trigger means for triggering the movement of the indicator from the loaded position to the replacement recommendation position under the force of the spring.

13. The removable workpiece of claim 12, wherein the trigger means includes a time based trigger.

14. The removable workpiece of claim 12, wherein the trigger means is configured to trigger the release of the indicator based on one or more of abrasion, adhesion, solubility, time, heat, and light.

15. A removable workpiece for use with a motorized personal appliance, comprising:

a body having an outer surface;

a treatment applicator coupled to the outer surface of the body, wherein the treatment applicator is configured to apply treatment to a subject's skin; and a replacement indicator carried by the body and configured to move between a spring biased position and a spring unbiased position;

a biodegradable retainer configured to retain the replacement indicator at the spring biased position, wherein the biodegradable retainer is configured to trigger the movement of the replacement indicator from the spring biased position to the spring unbiased position based on time and environmental conditions.

16. The removable workpiece of claim 15, wherein the environmental conditions include one or more of exposure to heat, light and/or moisture.

17. The removable workpiece of claim 15, wherein the replacement indicator is a biodegradable replacement indicator, and wherein the biodegradable replacement indicator and/or the biodegradable retainer is configured to trigger the movement of the biodegradable replacement indicator from the spring biased position to the spring unbiased position based on time and environmental conditions.

18. A removable workpiece for use with a motorized personal appliance, comprising:

a body having an outer surface;

a treatment applicator coupled to the outer surface of the body, wherein the treatment applicator is configured to apply treatment to a subject's skin; and a biodegradable replacement indicator carried by the body and configured to move between a spring biased position and a spring unbiased position;

a retainer configured to retain the biodegradable replacement indicator at the spring biased position, wherein the biodegradable replacement indicator is configured to trigger the movement of the biodegradable replacement indicator from the spring biased position to the spring unbiased position based on time and environmental conditions.

* * * * *